US008916802B2

(12) United States Patent
Bringe et al.

(10) Patent No.: US 8,916,802 B2
(45) Date of Patent: Dec. 23, 2014

(54) HOUSEHOLD APPLIANCE HAVING A DRIP GUARD FOR A WARMING DRAWER

(75) Inventors: William Bringe, Powell, TN (US); Samuel Harward, Knoxville, TN (US); Rose Marie Parker, Caryville, TN (US); Michael Rutherford, Duff, TN (US)

(73) Assignee: BSH Home Appliances Corporation, Irvine, CA (US)

( * ) Notice: Subject to any disclaimer, the term of this patent is extended or adjusted under 35 U.S.C. 154(b) by 282 days.

(21) Appl. No.: 13/483,096

(22) Filed: May 30, 2012

(65) Prior Publication Data

US 2013/0319994 A1 Dec. 5, 2013

(51) Int. Cl.

| | |
|---|---|
| ***F24C 7/06*** | (2006.01) |
| ***F24C 15/14*** | (2006.01) |
| ***F24C 15/18*** | (2006.01) |
| ***H05B 3/22*** | (2006.01) |
| ***H05B 3/26*** | (2006.01) |
| ***F24C 15/36*** | (2006.01) |
| ***F24C 15/10*** | (2006.01) |
| *H05B 3/68* | (2006.01) |
| *H05B 3/74* | (2006.01) |

(52) U.S. Cl.

CPC ..... *F24C 15/18* (2013.01); *F24C 15/36* (2013.01); *F24C 15/104* (2013.01); *F24C 15/102* (2013.01); *H05B 3/68* (2013.01); *H05B 3/74* (2013.01)

USPC ..... 219/385; 219/452.11; 219/455.11; 219/536; 219/541; 219/521

(58) Field of Classification Search

CPC .... H05B 1/0252; H05B 1/0294; H05B 3/265; H05B 3/68; H05B 3/74; H05B 3/746; H05B 3/748; H05B 2203/013; H05B 2203/016; H05B 2203/028; H05B 2203/033; F24C 7/06; F24C 7/083; F24C 15/102; F24C 15/104; F24C 15/105; F24C 15/18

See application file for complete search history.

(56) References Cited

U.S. PATENT DOCUMENTS

| | | | | |
|---|---|---|---|---|
| 2,424,412 | A * | 7/1947 | Myers | 219/448.11 |
| 2,839,656 | A * | 6/1958 | Weyrick | 219/456.1 |
| 2,976,386 | A * | 3/1961 | Salton | 219/450.1 |
| 3,521,029 | A * | 7/1970 | Toyooka et al. | 219/201 |
| 3,883,719 | A * | 5/1975 | Hurko | 219/466.1 |
| 3,987,275 | A * | 10/1976 | Hurko | 219/451.1 |
| 4,068,115 | A * | 1/1978 | Mack et al. | 219/386 |

(Continued)

FOREIGN PATENT DOCUMENTS

GB 335540 A * 9/1930

*Primary Examiner* — Joseph M Pelham

(74) *Attorney, Agent, or Firm* — James E. Howard; Andre Pallapies

(57) ABSTRACT

A household appliance includes a warming drawer housing having an interior chamber, and a warming drawer module in the interior chamber. The module includes a support plate, a glass heating element forming a floor surface of the module for receiving items to be warmed, a gasket strip covering an upper perimeter surface of the glass heating element, a frame disposed over the gasket strip and the upper perimeter surface, and a first electrical connection disposed adjacent to an edge of the frame. The frame includes a drip guard projecting outward from the edge of the frame and overhanging the first electrical connection to guide a liquid from a surface of the frame or the glass heating element away from the first electrical connection such that the liquid does not come into contact with the first electrical connection.

28 Claims, 20 Drawing Sheets

(56) References Cited

U.S. PATENT DOCUMENTS

| | | | | |
|---|---|---|---|---|
| 5,198,638 | A * | 3/1993 | Massacesi | 219/209 |
| 5,276,310 | A * | 1/1994 | Schmidt et al. | 219/521 |
| 5,347,609 | A * | 9/1994 | Huff | 392/309 |
| 5,508,495 | A * | 4/1996 | Yahav et al. | 219/466.1 |
| 5,653,905 | A * | 8/1997 | McKinney | 219/400 |
| 6,037,572 | A * | 3/2000 | Coates et al. | 219/451.1 |
| 6,384,380 | B1 * | 5/2002 | Faries et al. | 219/385 |
| 7,009,151 | B2 * | 3/2006 | Lee | 219/460.1 |
| 7,170,035 | B2 * | 1/2007 | Peterson et al. | 219/386 |
| 7,208,700 | B2 * | 4/2007 | Peterson et al. | 219/386 |
| 7,235,762 | B2 * | 6/2007 | Gagas et al. | 219/400 |
| 7,279,659 | B2 * | 10/2007 | Gagas et al. | 219/400 |
| 7,488,919 | B2 * | 2/2009 | Gagas et al. | 219/400 |
| 7,619,182 | B2 * | 11/2009 | Morrow et al. | 219/391 |
| 2004/0149722 | A1 * | 8/2004 | Schnell et al. | 219/460.1 |
| 2005/0274712 | A1 * | 12/2005 | Gagas et al. | 219/494 |
| 2006/0043087 | A1 * | 3/2006 | Gagas et al. | 219/391 |
| 2006/0049172 | A1 * | 3/2006 | Gagas et al. | 219/521 |
| 2006/0052852 | A1 * | 3/2006 | Wyatt et al. | 607/104 |
| 2006/0278629 | A1 * | 12/2006 | Gagas et al. | 219/385 |

* cited by examiner

HOUSEHOLD APPLIANCE HAVING A DRIP GUARD FOR A WARMING DRAWER

CROSS-REFERENCES TO RELATED APPLICATIONS

This application is related to Applicants' co-pending U.S. applications, which are filed concurrently herewith, entitled "HOUSEHOLD APPLIANCE HAVING A DEPLOYABLE WARMING DRAWER MODULE", Ser. No. 13/483,098; "HOUSEHOLD APPLIANCE HAVING A WARMING DRAWER WITH A THERMALLY CONDUCTIVE LAYER", Ser. No. 13/483,097; "HOUSEHOLD APPLIANCE HAVING A THERMOSTAT RETAINER FOR A THERMOSTAT OF A WARMING DRAWER", Ser. No. 13/483,093; "HOUSEHOLD APPLIANCE HAVING EMBOSSES SUPPORTING A GLASS HEATING ELEMENT OF A WARMING DRAWER", Ser. No. 13/483,094, each of which is incorporated herein by reference in its entirety.

FIELD OF THE INVENTION

The present invention is directed to a household appliance having a warming drawer, and more particularly, to a household appliance having a warming drawer module with a glass heating element and a drip guard to guide spills, liquids, and other contaminants away from an electrical connection.

BACKGROUND OF THE INVENTION

Some conventional household appliances may include a warming drawer for warming one or more items P such as food, cookware, cutlery, etc. or maintaining a predetermined temperature of the items. As shown for example in FIG. 1, a conventional warming drawer 1 commonly may include a housing 2 and a drawer 4 having four walls 6, a floor 8, and a handle 10, similar to an ordinary drawer. The drawer 4 may be slidably coupled to the housing 2 by ordinary drawer slides 12 mounted on the interior sidewalls of the housing 2 or to the floor of the housing 2. The functional parts of the warming drawer commonly are attached to the housing 2 of the warming drawer 1. For example, a heating element 14 commonly is fixed to the interior of the housing 2, such as on the floor of the housing 2. In operation, the drawer 4 moves over the heating element 14 when the drawer 4 is in a closed position inside the housing 2 to heat the items P in the drawer 4. The controls (not shown) for the conventional warming drawer 4 commonly are provided on the warming drawer housing 2 or on the housing of the appliance.

SUMMARY OF THE INVENTION

The present invention is directed to a drip guard for guiding spills, liquids, or other contaminants on a warming drawer module away from electrical components. The present invention also can provide means for draining such spills or liquids from the warming drawer module. In this manner, the exemplary embodiments can provide a simple, cost effective, and reliable means for minimizing or preventing a risk of damage, electrical grounding, etc. of the electrical components or connections of the warming drawer due to spills, liquids, or other contaminants. The exemplary embodiments can provide a drip guard with minimal additional manufacturing and without requiring additional components or pieces. The exemplary embodiments can provide a drip guard that reliably minimizes or prevents spills, liquids, or other contaminants from contacting electrical components using a single, integral feature that does not require additional steps or materials to seal the drip guard, such as caulking or adhesives.

Prior to describing the exemplary embodiments in greater detail, and to provide a better understanding of the invention, this disclosure will first describe some of the problems with conventional warming drawer designs and other background information with respect to the warming drawer designs, along with an explanation of the reasons for improving the arrangement of the warming drawer and the corresponding advantages provided by the present invention.

A conventional warming drawer having a heating element fixed to the interior of the housing and the warming drawer moving over the heating element when the warming drawer is moved to a closed position may have limited or reduced heat transfer between the heating elements and the warming drawer and the contents of the warming drawer and the heat transfer may vary for different positions in the drawer, thereby resulting in hot spots in the drawer. Assembly and repair work for components of such a warming drawer commonly may be difficult to perform particularly where the appliance is installed in cabinetry. The assembly of the parts of the warming drawer within the warming drawer housing during manufacturing also can be complex and time-consuming.

To solve the foregoing problems, a warming drawer has been provided in which functional parts of the warming drawer are assembled together into a sub-assembly or warming drawer module that easily can be inserted and removed from the warming drawer housing by manufacturing personnel, a user, or a repair technician. A heating device may be coupled to and movable with the warming drawer module in and out of the housing. In this way, the warming drawer module can improve heat transfer, and provide more uniform and predictable heat transfer, between the heating element and the contents of the warming drawer module, thereby providing uniform heating at various positions in the drawer and reducing or eliminating hot spots in the warming drawer module. The warming drawer module also can simplify and improve the ease with which assembly and repair work can be performed for components of the warming drawer by enabling the warming drawer module to be removed from the warming drawer housing with a simple connection such that a user or technician can easily and simply perform repairs, replacement, and/or cleaning without having to remove the warming drawer housing. Electrical and control wires and cable, as well as wire and cable routing features, also may be coupled to or included in the deployable warming drawer module so that manufacturing personnel, a user, or a repair technician do not have to route wires or cables when installing and/or removing the warming drawer module.

The heating device of the warming drawer module may be provided by a ceramic/glass heating element that forms a floor surface of the module for receiving the items to be warmed and that provides uniform heat across the entire floor surface of the warming drawer, while also being easy to clean and providing an aesthetically pleasing appearance, for example, when the drawer is deployed form the warming drawer housing. In this case, the underside of the glass commonly has a thin metal layer or conductive coating which, when supplied with an electric current, generates heat evenly across the entire surface of the ceramic/glass heating element. As a result, the entire surface of the ceramic/glass heating element can generate heat and form a portion of an electric circuit.

The present invention recognizes that the ceramic/glass heating element, which forms the floor surface of the warming drawer module for receiving the items to be warmed, may be exposed to spills, liquids, or other contaminants from items to be warmed, cleaning liquids, etc. Additionally, since the warming drawer module can include the functional parts of the warming drawer, such spills, liquids, or other contaminants may come into contact with electrical components or connections of the warming drawer module, including for example, the electrical connections of the ceramic/glass heating element, theremostats, control components, or power supply components or wires/cables.

An exemplary embodiment, therefore, is directed to means for guiding spills, liquids, or other contaminants on the warming drawer module away from electrical components. The exemplary embodiments also can provide means for draining such spills or liquids from the warming drawer module.

In an exemplary embodiment, the warming drawer module can include a support plate supporting the ceramic/glass heating element. The warming drawer module further can include one or more gasket strips covering an upper edge or perimeter surface of the ceramic/glass heating element, which may be directly exposed to the spills, liquids, or other contaminants. A frame can be disposed over the gasket strips and the glass heating element, and then secured to the support plate, thereby providing a seal between the ceramic/glass heating element and the frame and preventing spills or liquids from entering the space, which may include electrical components, between the ceramic/glass heating element and the frame at the intersection of the ceramic/glass heating element and the frame.

The present invention recognizes that, because of the arrangement of the warming drawer and the seal between the ceramic/glass heating element and the frame, a spill, liquid, or other contaminant on the ceramic/glass heating element and/or the frame may have nowhere to go, and therefore, may run over the edge of the frame and down a side of the frame. If such spills or liquid run off or drip off the side edges of the frame (i.e., the side edges connecting the front panel to the rear panel of the warming drawer), then the spills, liquids, or other contaminants simply may fall onto the floor without coming into contact with any electrical components in the warming drawer module. However, the present invention recognizes that, if such spills, liquids, or other contaminants run off or drip off of an edge of the frame, for example, where a front panel (which includes the control panel) abuts the frame, then there may be a higher risk that part or all of a spill, liquid, or other contaminant may run into an area where electrical components or connections (e.g., wiring harness connectors such as a 6-pin connector or the like) of the heating element, thermostats, control wires/cables, and/or power supply wires/cables are coupled to one or more corresponding electrical components or connections of the front cover, which includes the control panel for controlling an operation of one or more of these electrical components.

An exemplary embodiment, therefore, is directed to means for guiding or channeling spills, liquids, or other contaminants away from electrical components and connections (e.g., wiring harness connectors) of the warming drawer module, and more particularly, away from electrical components and connections (e.g., wiring harness connectors) in a front area of the warming drawer module where the front panel abuts the frame, and where electrical components or connections (e.g., wiring harness connectors) of the heating element, thermostats, control wires/cables, and/or power supply wires/cables are coupled to one or more corresponding electrical components or connections of the front cover (which may include the control panel for controlling an operation of one or more electrical components of the warming drawer module). In this manner, the exemplary embodiments can minimize or prevent a risk of damage, electrical grounding, etc. of the electrical components or connections of the warming drawer due to spills, liquids, or other contaminants.

In an exemplary embodiment, the warming drawer module can include a drip guard, for example on a front portion of the frame, for guiding or channeling spills, liquids, or other contaminants away from electrical components and connections (e.g., wiring harness connectors) of the warming drawer module, and more particularly, away from electrical components and connections (e.g., wiring harness connectors) in a front area of the warming drawer module where the front panel (including the control panel for controlling an operation of one or more electrical components of the warming drawer module) abuts the frame, and where electrical components or connections (e.g., wiring harness connectors) of the heating element, thermostats, control wires/cables, and/or power supply wires/cables are coupled to one or more corresponding electrical components or connections of the front cover.

The drip guard can be configured to extend from a portion of a front edge of the frame, for example, at a location corresponding to (i.e., above) a wiring harness connector for connecting the electrical components of the warming drawer floor assembly with electrical components of a front panel assembly. The drip guard can function, for example, in a manner similar to an eave on a house by guiding spills, liquids, or other contaminants over and away from the wiring harness connector and, for example, to a lower surface of the front panel. The drip guard can overhang and extend past the wiring harness connector such that any spills, liquids, or other contaminants on the ceramic/glass heating element and/or frame are guided away and do not enter or contact the electrical wiring harness connector.

The drip guard can be formed as a single piece integrated into the frame (e.g., a stainless steel frame) used to secure and seal the ceramic/glass heating element to the support plate. The drip guard can be formed by cutting a portion of the frame, for example, that is substantially perpendicular to a surface of the heating element at a location corresponding to (i.e., above) a location of the wiring harness connector to be protected from spills and then subjecting the portion to bending forces until the portion is disposed at an angle extending outward from the frame at an angle other than perpendicular to the surface of the glass heating element. In this way, a so-called "eave" or the drip guard can be formed for protecting an underlying electrical connection or wiring harness connector from spills, liquid, or other contaminants that may run off of a warming surface of the warming drawer module. The drip guard can be disposed, for example, at an angle with respect to the surface of the ceramic/glass heating element such that the drip guard is sloped in a downward direction away from the frame and/or glass heating element to drain the spill, etc. away from these components, such as a 10 degree angle, 30 degree angle, 45 degree angle, or other angle.

In an embodiment, the drip guard can extend into a space within a front panel of the warming drawer, for example, which includes the control unit for controlling the warming drawer and electronics of the control panel. In an embodiment, the frame and/or the support plate can be coupled to the front panel via a mounting plate or rear cover that encloses a rear side of the front panel. The drip guard can be configured to extend through an opening formed in the mounting plate or rear cover. The electrical wiring harness connector also can be configured to be disposed in the opening in the mounting plate or rear cover such that the wiring harness connector is accessible and connectible to a corresponding wiring harness connector of the front panel.

In another exemplary embodiment, the drip guard can be configured to extend along substantially all of the front edge of the frame or along the entire front edge of the frame, thereby ensuring that the electrical components or connections for connecting the electrical components of the floor assembly of the warming drawer module with electrical components of a front panel assembly are protected from spills, liquids, or other contaminants.

In another exemplary embodiment, a plurality of drip guards can be configured to extend from the edge of the frame at locations above a plurality of electrical components or connections, thereby individually protecting respective electrical components or connections from spills, liquids, or other contaminants.

In another exemplary embodiment, the drip guard can be formed from a separate piece or part that is coupled to, for example, the frame, the interior of the front panel, or the mounting plate or rear cover of the front panel.

An exemplary drain guard can be formed, for example, from stainless steel particularly in instances when the drip guard is formed from a portion of the frame (i.e., stainless steel frame). In other embodiments, the drip guard can be formed from other materials, particularly in instances in which the drip guard is separately formed and coupled to the frame, front panel, mounting plate or rear cover of the front panel, or other component. For example, the drip guard can be a polymer plate, an aluminum plate, among other materials.

In another exemplary embodiment, the drip guard can be configured to guide the spill, etc. to an area of the warming drawer module having one or more drain holes that permit the spill, etc. to pass safely out of the warming drawer module. For example, the front panel of the warming drawer module can include a lower portion having one or more drain holes that permit the spill, etc. to drain safely out of the warming drawer module.

In another exemplary embodiment, the drip guard can be configured to guide the spill, etc. to an area of the warming drawer module having a reservoir or drain pan for collecting or holding the spill, etc. until the spill, etc. can evaporate over time, or until the spill, etc. can drain through one or more drain holes.

In this manner, the exemplary embodiments can provide a simple, cost effective, and reliable means for minimizing or preventing a risk of damage, electrical grounding, etc. of the electrical components or connections of the warming drawer due to spills, liquids, or other contaminants. The exemplary embodiments can provide a drip guard with minimal additional manufacturing and without requiring additional components or pieces. The exemplary embodiments can provide a drip guard that reliably minimizes or prevents spills, liquids, or other contaminants from contacting electrical components using a single, integral feature that does not require additional steps or materials to seal the drip guard, such as caulking or adhesives.

In the exemplary embodiments, a household appliance can include a warming drawer with a fixed warming drawer module and glass heating element or a warming drawer module having a glass heating element that is movable in and out of a warming drawer housing.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

Figure 1:
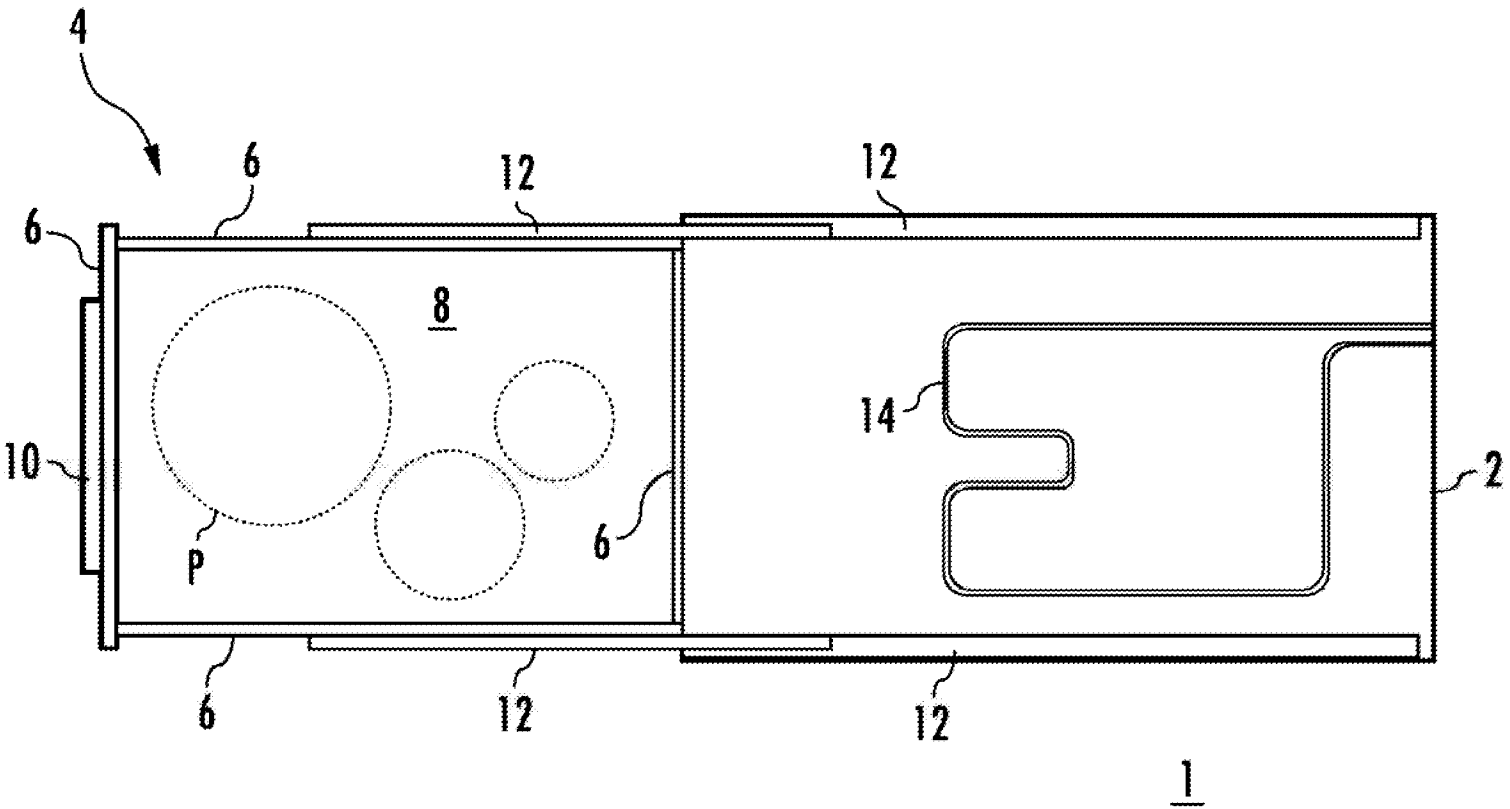
FIG. 1 PRIOR ART
FIG. 1 is a plan view of a conventional household appliance having a warming drawer.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 2-20 illustrate exemplary embodiments of a household appliance having a warming drawing including a drip guard. Prior to describing the exemplary embodiments of the drip guard in greater detail, and to provide a better understanding of the invention, this disclosure will first describe an exemplary warming drawer assembly that derives particular advantages from the drip guard according to the present invention.

Figure 2:
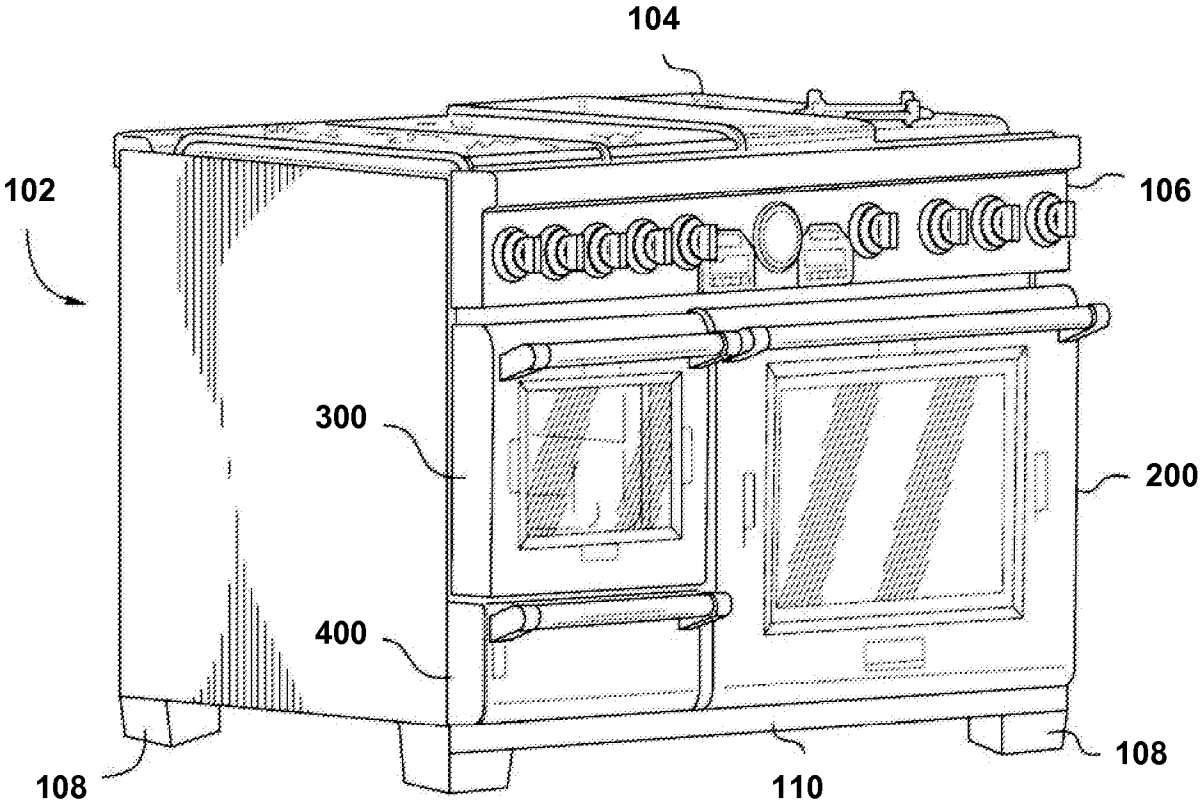
FIG. 2 is a perspective view of a household appliance according to an exemplary embodiment of the invention.

With reference to FIG. 2, an exemplary household appliance 100 can include a cooking range having a housing 102 including one or more cooking or warming devices, such as a cooktop, gas oven, electric oven, steam oven, convection oven, and/or warming drawer. In other embodiments, the appliance 100 can include one or more oven cooking chambers without a cooktop. In other embodiments, the appliance 100 can include a standalone appliance, wall mounted appliance, or countertop appliance, such as a stand-alone warming drawer, wall mounted warming drawer, or countertop warming drawer. The appliance housing 102 can include, for example, a cooktop 104 and control panel 106. The cooktop 104 can include, for example, a gas cooktop having a plurality of gas burners, or other types of cooktops, such as an electric cooktop, an induction cooktop, or the like. The exemplary household appliance 100 can include one or more doors, such as a baking oven door 200, a steam oven door 300, and/or a warming drawer door 400 for providing access to one or more chambers of the housing 102. The housing 102 can include pedestal feet 108 for example for supporting the stand alone appliance and a kick panel 110.

Figure 3:
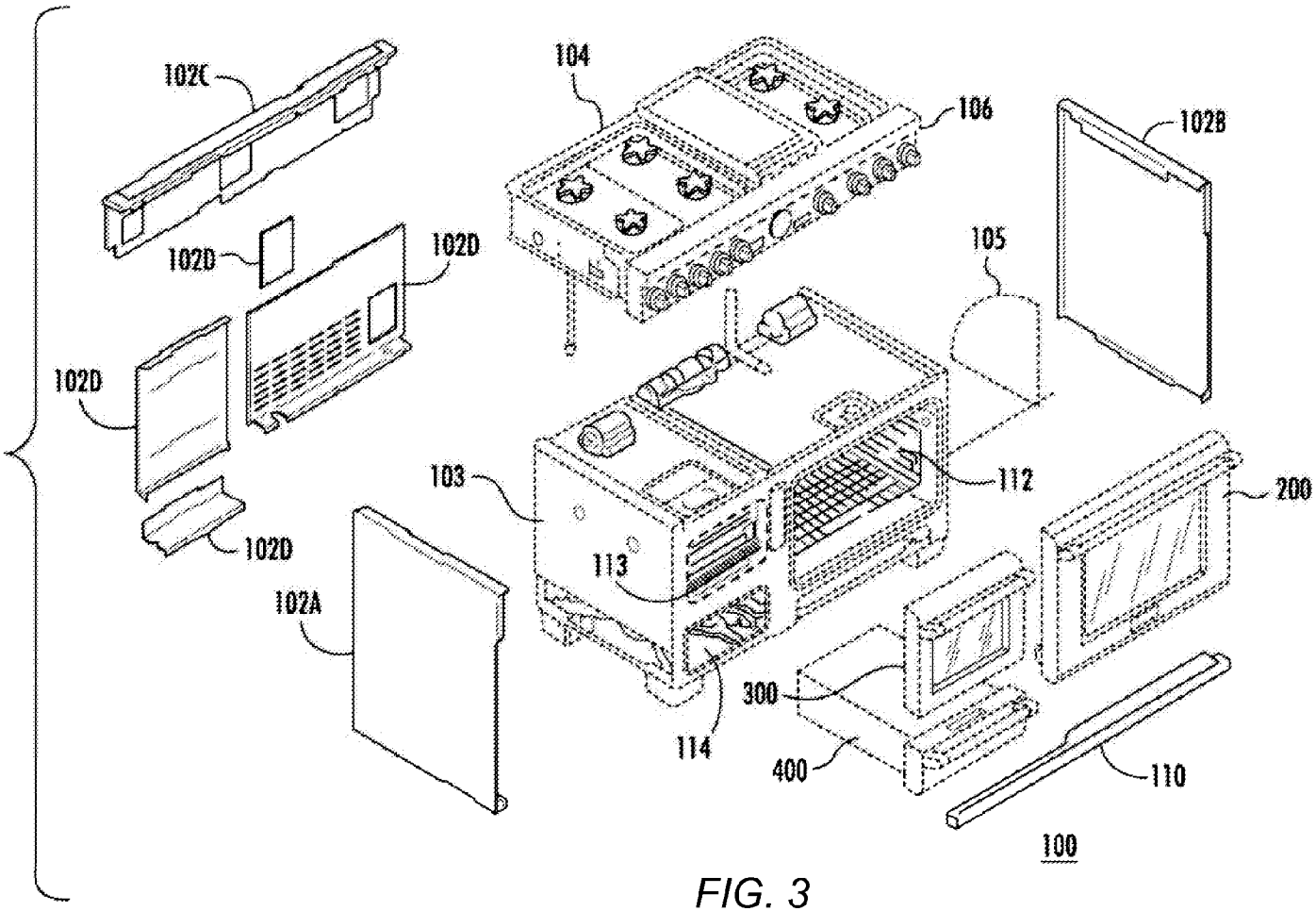
FIG. 3 is an exploded view of a household appliance according to an exemplary embodiment of the invention.

Referring to FIG. 3, the housing 102 of the exemplary household appliance 100 shown in FIG. 2 further can include, for example, left-hand and right-hand sidewalls 102A, 102B and one or more rear panels 102D on a frame 103. The exemplary appliance 100 can include other devices and features, such as, for example, a backsplash 102C, hideaway label plate 105, etc. The frame 103 can include one or more chambers for cooking or warming devices, such as a baking oven chamber 112, steam oven chamber 113, and/or warming drawer chamber 114.

Figure 4:
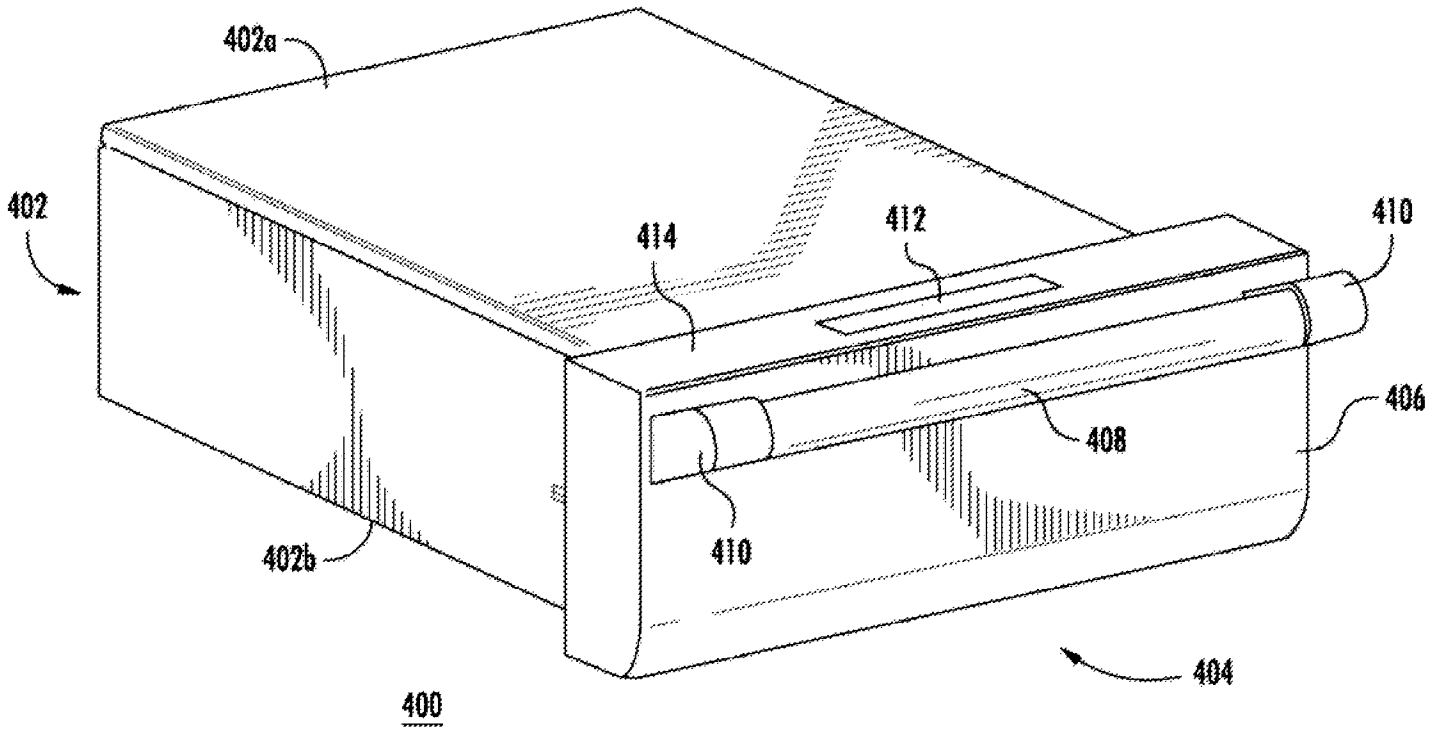
FIG. 4 is a perspective view of a warming drawer according to an exemplary embodiment of the invention.

With reference to FIG. 4, an exemplary embodiment of a modular warming drawer 400 will now be described in which the functional components of the warming drawer are deployable from within a fixed warming drawer housing.

Figure 6:
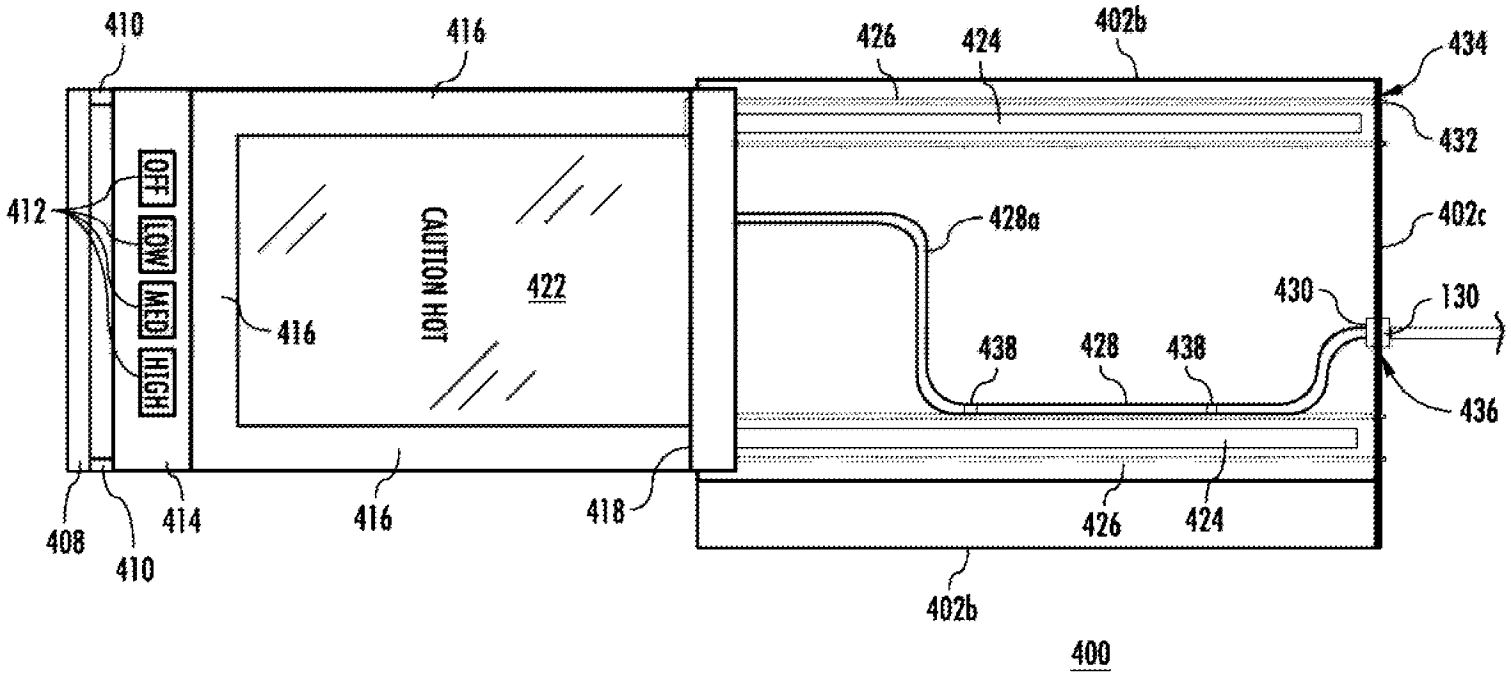
FIG. 6 is a plan view of a warming drawer having a deployed warming drawer module according to an exemplary embodiment of the invention.

The modular warming drawer 400 can include, for example, a fixed warming drawer housing 402 having a top 402*a*, a bottom (not visible in FIG. 4), sidewalls 402*b*, and a rear wall (not visible in FIG. 4). The top, bottom, sidewalls, and/or rear wall of the warming drawer housing 402 can be, for example, stainless steel panels. The warming drawer housing 402 can be disposed in the warming drawer chamber 114 shown in FIG. 3. The modular warming drawer 400 can include, for example, a deployable warming drawer module 404 having a front panel 406, a handle 408 coupled to the front panel 406 via, for example, handle mounts 410. The front panel 406 and other portions thereof can include, for example, one or more stainless steel panels. The deployable warming drawer module 404 can include, for example, a control panel 412 for controlling the functions of the warming drawer module 404. The control panel 412 can be, for example, a concealed control panel on or recessed within the upper surface 414 of the front panel 406, which is visible to a user only when the warming drawer module 404 is in a deployed position, as illustrated in FIG. 6 described in greater detail below. In other embodiments, the control panel 412 can be on or recessed within the face of the front panel 406 or a side of the front panel 406. The control panel 412 can include, for example, one or more touch-activated switches for controlling an operation of the warming drawer 400, such as, for example, an 'OFF' setting, a 'LOW' setting, a 'MED' setting, and a 'HIGH' setting.

Figure 5:
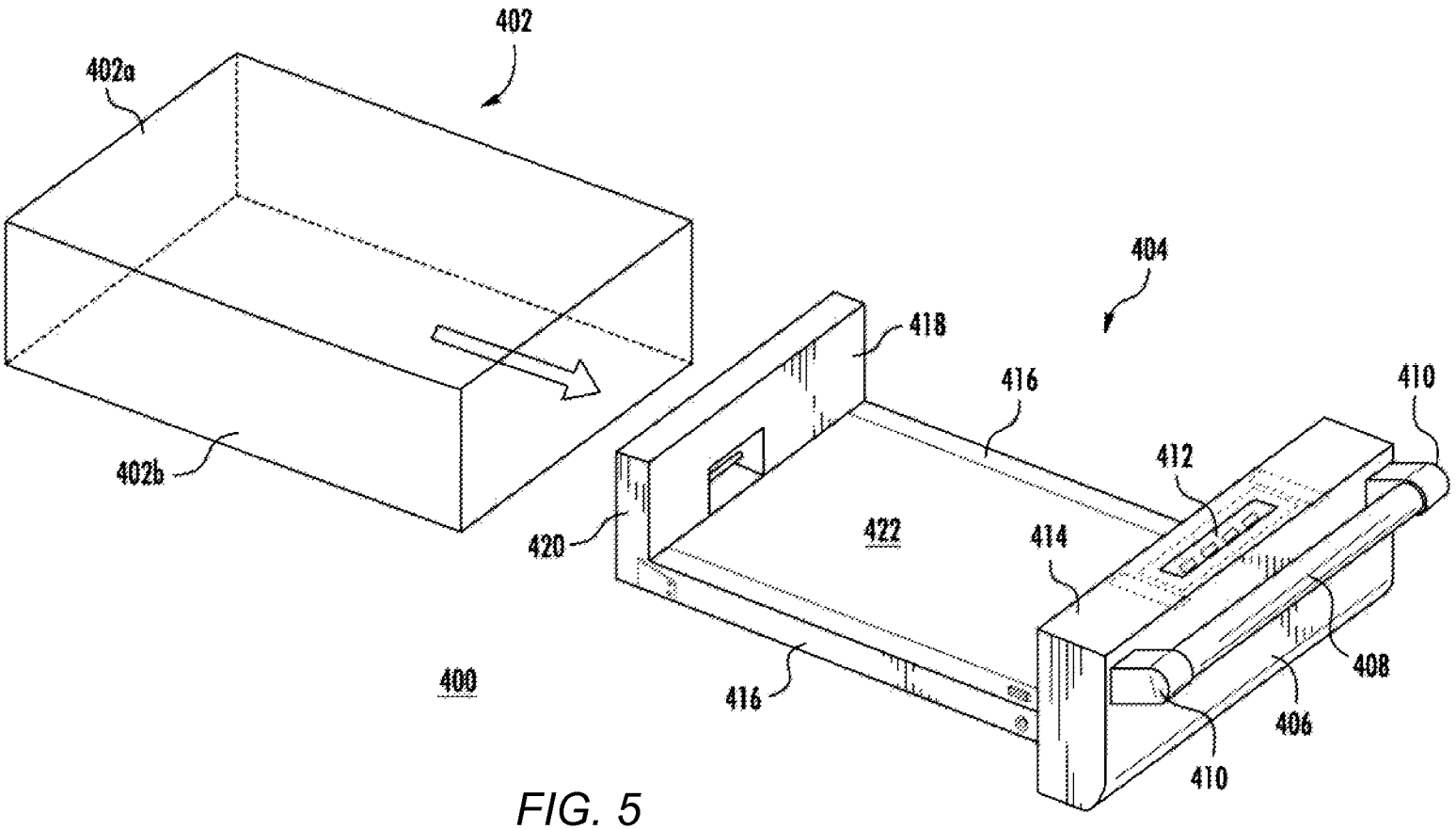
FIG. 5 is a partially exploded perspective view of a warming drawer according to an exemplary embodiment of the invention.

With reference to FIGS. 5 and 6, the exemplary warming drawer module 404 can include a frame 416 coupled to the front panel 406, and a rear panel 418 coupled to an opposite end of the frame 416, for example, via a bracket portion 420 (which may separately or integrally formed with the rear panel 418). The exemplary warming drawer module 404 can include a heating device, such as a sheet glass or glass/ceramic heating element 422, which is disposed in or supported by the frame 416. The sheet glass or glass/ceramic heating element 422 can form a floor surface of the warming drawer module 404, such as a warming surface for supporting (e.g., directly supporting) items to be warmed. The heating element 422 can be supplied with power from a power source and controlled by the control panel 412 to selectively provide one or more predetermined temperatures for the warming area in the warming drawer module or the floor surface of the warming drawer module. Exemplary embodiments of a heating element is described in greater detail with reference to FIG. 8. The warming drawer module 404 can be, for example, slidably deployable from within the warming drawer housing 402 using various arrangements of various types of drawer slides.

With reference again to FIGS. 5 and 6, the warming drawer module can be configured without sidewalls (e.g., without a left-hand sidewall or right-hand sidewall) connecting the front panel 406 to the rear panel 418, thereby improving and simplifying a user's access to the warming area, and particularly to the heating element 422, for example, for loading and unloading plates, cookware, cutlery, and/or food into and out of the warming drawer module 404. In other embodiments, the warming drawer can include a left-hand sidewall or a right-hand sidewall connecting at least one side of the front panel 406 to the rear panel 418. In still other embodiments, the warming drawer can include a left-hand sidewall and a right-hand sidewall connecting both sides of the front panel 406 to the rear panel 418. In another embodiment, the warming drawer module 404 can include only the front panel 406 without a left-hand sidewall, right-hand sidewall, or rear panel 418. The frame 416 and optional rear panel 418 and/or side panels can be, for example, stainless steel panels.

As shown in FIGS. 5 and 6, the exemplary warming drawer module 404 can be movable in a direction (shown by an arrow in the exploded view of FIG. 5) from a first position (e.g., a stored position as shown in FIG. 4) within the warming drawer housing 402 to a second position, such as a deployed position (e.g., as shown in FIG. 6) that is at least partially outside of the warming drawer housing 402 and that permits access to an interior of the warming drawer module 404 (e.g., access to the glass/ceramic heating element 422) or access to concealed controls (if equipped) (e.g., 412) of the warming drawer module 404, as exemplarily illustrated in FIGS. 5 and 6. The deployed position can include various partially or fully deployed positions of the warming drawer module 404 with respect to the warming drawer housing 402 and is not limited to the illustrated positions in the Figures.

As shown in FIGS. 5 and 6, the exemplary warming drawer module 404 can include one or more functional components (e.g., heating element 422, electrical wires 428, and/or control components 412) of the warming drawer 400 such that one or more of these functional components move with the warming drawer module 404 between the first position and the second position. The controls of the warming drawer 400 can be disposed on (i.e., on-board) the warming drawer module 404 such that the controls 412 are accessible when the warming drawer module 404 is in a deployed position and concealed by the appliance housing or another door on the appliance housing when the warming drawer 400 is in the first (i.e., closed) position. In other embodiments, the controls can be electrically connected to the warming drawer module 404 but remotely located from the warming drawer module 404, such as on the warming drawer housing 402, the housing (102 in FIG. 2) of the appliance 100, the control panel (106 in FIG. 2) of the appliance 100, etc.

The exemplary warming drawer module 404 can be movable further in the direction shown in FIG. 5 from the first position to a third position in which the warming drawer module 404 is removed completely from the warming drawer housing 402, such that the functional components (e.g., all of the functional components) of the warming drawer 400 are accessible to a user or a repair technician.

With reference to FIG. 6, an exemplary warming drawer module 404 is illustrated in a deployed position (e.g., a fully deployed position). The warming drawer module 404 can include one or more slides 424 for facilitating movement of the warming drawer module 404 (including the functional components, such as the heating element 422) between the stored position in the warming drawer housing 402 and the deployed position outside of the warming drawer housing 402. The slides 424 can be coupled, for example, directly to a part of the warming drawer housing 402, such as the floor for the warming drawer housing 402. The warming drawer module 404 optionally can include means for increasing the rigidity and stiffness and reducing deflection of the warming drawer module 404, such as one or more channels or supports 426 (shown with dashed lines) (e.g., channels or supports having a U-shaped, I-shaped, T-shaped, L-shaped, square-shaped, rectangular-shaped, circular-shaped, or oval-shaped cross-section) to increase the rigidity of the warming drawer module 404, stiffen the slide mounting, reduce deflection of a part of the warming drawer housing 402 or the warming drawer module 404, etc., particularly when the warming drawer module 404 is in a deployed position and/or in a loaded position. A drawer slide 424 can be coupled to the frame 416 of the warming drawer module and to the channels 426, which in turn can be coupled to the warming drawer housing 402 at one or more locations (e.g., floor, sidewall, rear wall, and/or frame of the warming drawer housing 402). In this way, the warming drawer module 404 can be coupled to the warming drawer housing 402 via one or more channels 426.

As shown in FIG. 6, a channel 426 can include one or more locking features or means for securing the channel 426 to the warming drawer housing 402, for example, one or more protrusions 432 on an end of the channel that engage an opening 434 in a rear panel 402*c* of the warming drawer housing 402. The locking feature or means can include one of more openings (not shown) formed in a portion of a front end of the channel 426 for receiving a fastening device and securing the front end of the channel 426, or another portion of the channel 426, to a part of the warming drawer housing 402 that can be easily accessed by a user or technician from a front area of the warming drawer 400 without removing the warming drawer module 404 or warming drawer housing 402.

The warming drawer module 404 can include a cable harness 428 for guiding one or more electrical wires or cables and/or data wires or cables to one or more components or parts of the warming drawer module 404, or one or more individual or bundled wires and/or cables. One or more of the wires or cables can include an electrical connection 430 that is electrically coupled to an electrical connection 130 of the household appliance 100, such as an electrical connection to a power supply connection, data connection, or control connection of the household appliance 100. The electrical connection 130 can be mounted in an opening 436 in the rear panel 402*c* of the warming drawer housing 402, as shown in FIG. 6. The warming drawer module 404 also can include cable routing or management devices such that users or repair technicians do not need to route wires or cables when installing and/or removing/repairing the functional parts of the warming drawer module 404. For example, the cable harness 428 can be coupled to one or more of the channels 426 at one or more locations using one or more coupling devices 438 (e.g., cable ties, clamps, or the like) to prevent snagging or kinking of the cable harness 428 and/or wires/cables during movement of the warming drawer module 404 in and out of the warming drawer housing 402. The cable harness 428 can be provided with a freely bendable and movable portion 428*a* having sufficient length (e.g., slack) to permit the moveable portion of the warming drawer module 404 to move in and out of the warming drawer housing 402 between the stored position and the deployed position without disconnecting the electrical, data, or power supply connection (e.g., 430) of the warming drawer module 404 from the corresponding electrical connection 130 of the warming drawer housing 402.

As shown in FIG. 6, many or all of the functional components of the warming drawer 400, such as the glass/ceramic heater element 422 and controls 412, can be on the movable portion of the warming drawer module 404 such that the functional components move with the movable portion of the warming drawer module 404 in and out of the warming drawer housing 402.

Figure 7:
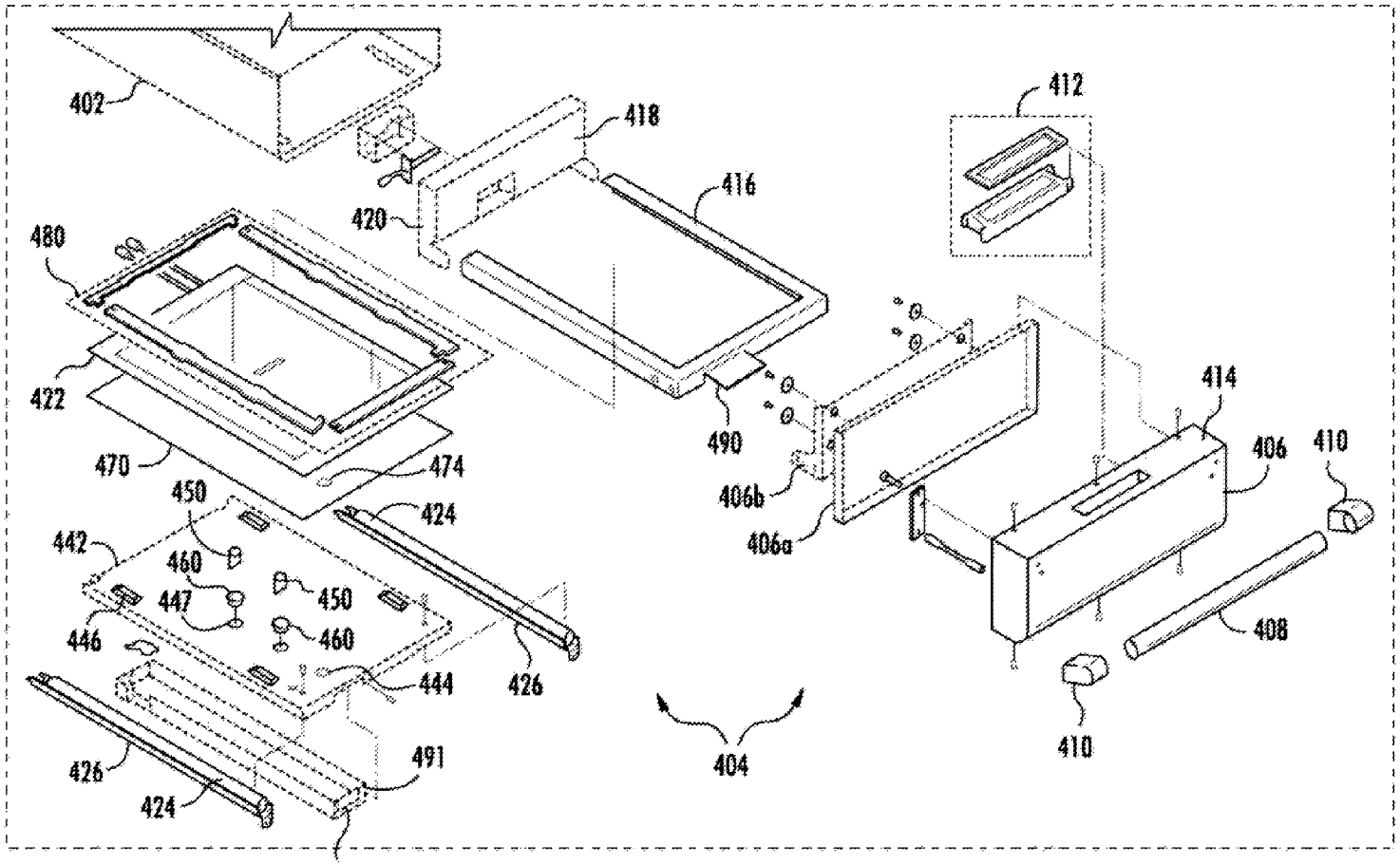
FIG. 7 is an exploded, perspective view of a warming drawer according to an exemplary embodiment of the invention.

With reference to FIG. 7, an exemplary embodiment of a warming drawer 400 will now be described in greater detail.

The exemplary warming drawer 400 can include, for example, a warming drawer housing 402 and a warming drawer module 404, shown in an exploded view. The warming drawer module 404 can include a front panel 406 having a handle 408 coupled to the front panel 406 via handle mounts 410. The front panel 406 can include a control panel 412 disposed in an opening or recess in an upper surface 414 of the front panel 406. The front panel 406 can include a mounting plate or rear cover 406*a* that encloses a rear side of the front panel 406 and a bracket 406*b* for coupling the mounting plate or rear cover 406*a* to a front portion of a frame 416 of the warming drawer module 404. A rear portion of the frame 416 can be coupled to a rear panel 418 via bracket portions 420 (which may separately or integrally formed with the rear panel 418).

As explained above, the warming drawer 400 can include a heating device assembly including a ceramic/glass heating element 422, which is described in greater detail with reference to FIG. 8. The ceramic/glass heating element 422 forms the floor of the warming drawer module 404, and thus, will be directly loaded with plates, cookware, cutlery, food, etc. To support an underside of the ceramic/glass heating element 422, a support plate 442 (e.g., stainless steel support plate) can be provided to support the glass heating element 422. The support plate 442 can include one or more supporting features, such as a plurality of embosses 446, for supporting the glass heating element 422 a predetermined distance above the support plate 442 and minimizing thermal and electrical contact areas between the heating element 422 and the support plate 442. Exemplary embodiments of a support plate having embosses is described in greater detail with reference for FIGS. 9A-11D. The support plate 442 also can include one or more openings 447 for receiving one or more thermostat retainers 460 that support and fix one or more thermostats 450 in a predetermined position and height above the surface of the support plate 442 and against the underside of the glass heating element 422.

A thermally conductive sheet 470 having low thermal resistance and high electrical resistance qualities can be disposed over the entire support plate 442, or at least the contact points between the plurality of embosses 446 and the thermostats 450 and the conductive underside of the glass heating element 422. In other embodiments, individual portions of thermally conductive tape (not shown) can be provided locally at each location of the embosses 446 and/or thermostats 450. The thermally conductive sheet 470 or thermally conductive tape can include, for example, UL (Underwriter Laboratories) listed silicone electrically insulating material. The glass heating element 422 can be disposed directly on the thermally conductive sheet 470 and supported by the plurality of embosses 446 under the sheet 470. Exemplary embodiments of a thermally conductive sheet and thermally conductive tape are described in greater detail with reference to FIGS. 13A-15C.

An upper edge or perimeter surface of the glass heating element 422 can be covered by one or more gasket strips 480 for spills or liquids. The frame 416 can be disposed over the gasket strips 480 and the glass heating element 422, and then secured to the support plate 442. The rear panel 418 may be disposed over a rear strip of the gasket strips 480. In this way, the glass heating element 422 can form both a floor surface of the warming drawer module 404 and the heating surface of the warming drawer module 404, thereby keeping spills or other liquids away from electrical components in the module 404, and such that the items to be warmed can be placed directly on the glass heating element 422 when the warming drawer 404 is deployed.

As shown in FIG. 7, the support plate 442 can include a wire guide 491 coupled to an underside of the support plate 442 for guiding one or more wires/cables from, for example, the thermostats 450, the heating element 422, or other electrical components to the interior of the front panel 406 and the control panel 412. The support plate 442 and the thermally conductive sheet 470 can include corresponding openings to permit the electrical leads from the glass heating element 422 to pass through the support plate 442 and the thermally conductive sheet 470 to the wire guide 491. A wiring harness connector 489 can be disposed at an end of the wire guide 491. The frame 416 optionally can include a drip guard 490 to protect the wiring harness connector 489 from spills, liquids, or other contaminants that may drain or run off of the glass heating element 422 or frame 416 during use. For example, the drip guard 490 can guide spills, cleaning solutions, etc. from the upper surface of the glass heating element 422 and the frame 416 away from and around a first electrical connector (such as a first wiring harness connector 489) in the wire guide 491 of the support plate 442, which may be disposed at an end of the wire guide 491, and a second electrical connector (such as a second wiring harness connector) in the front panel 406 the leads to the control panel 412, and/or away from the electrical components above or below the support plate 442 or on the glass heating element 422.

As explained above, the warming drawer module 404 and the functional components are movable in and out of the warming drawer housing 402. In the embodiment of FIG. 7, a pair of slides 424 can be coupled to the support plate 442, and particularly, for example, to the underside of the support plate 442. The channel 426 can be coupled to the slides 424 to complete the warming drawer module 404. One of ordinary skill will recognize that the warming drawer module 404 is not limited to particular features and arrangement shown in FIG. 7 and additional or alternative parts, components, and arrangements may be included in the warming drawer module 404 within the spirit and scope of the invention.

Figure 8:
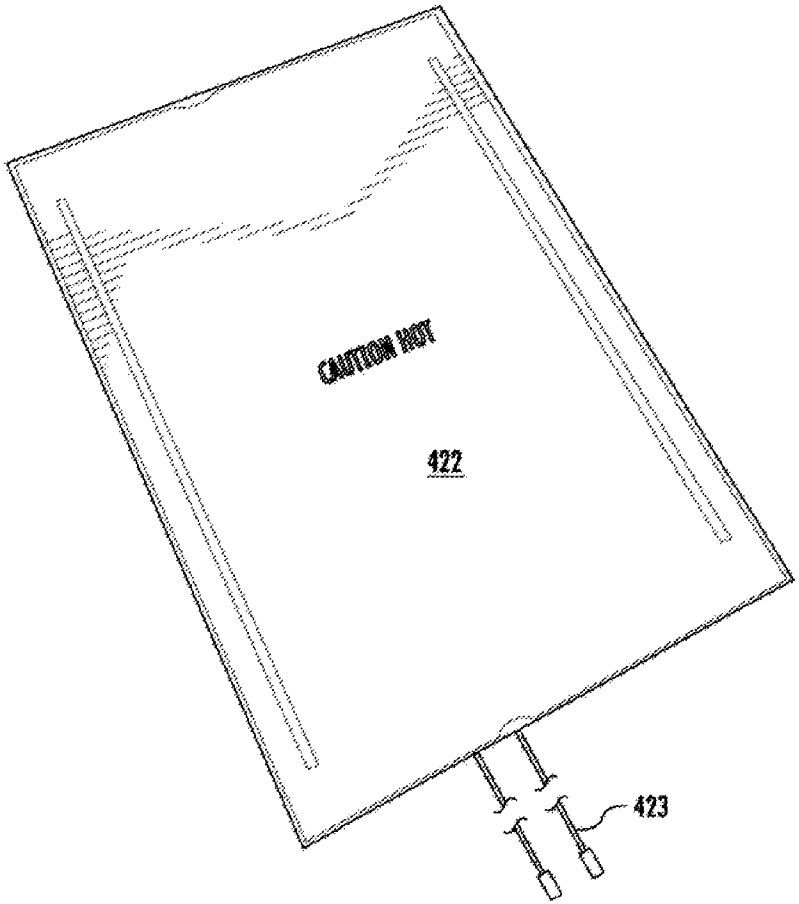
FIG. 8 is a perspective view of a heater device according to an exemplary embodiment of the invention.

With reference to FIG. 8, an exemplary heating device for a warming drawer module will now be described.

An exemplary heating device can include, for example, a ceramic/glass heating element 422 forming a floor surface of the warming drawer module for supporting the items to be warmed, such as food, plates, cookware, cutlery, etc. The heating element 422 can be a resistance heating element, for example, that operates similar to a rear window defroster of an automobile. The glass heating element 422 can include a glass ceramic surface having, for example, a plurality of heating element conducting paths or a uniform conductive coating (clear coating), for example, a 780 W element, thereby providing quick and even heating of items in the warming drawer module. More particularly, the underside of the ceramic/glass heating element 422 can include a thin metal layer or conductive coating that can generate heat evenly across the entire surface when provided with an electric current supplied, for example, by one or more power supply lines/wires/connectors 423. In the example, the entire surface can form a portion of an electric circuit such that the entire surface of glass/ceramic heating element 422 can generate heat (e.g., evenly generate heat). The ceramic/glass heating element 422 can provide uniform heat across an entire floor surface of the warming drawer module 404. The glass heating element can be easily cleaned, thereby reducing cleaning time and effort by the user for cleaning up spills, etc. from the floor surface of the warming drawer. The glass heating element 422 optionally may include other features, such as a hot surface indicator (e.g., active indicator) for notifying a user or technician when the heating surface is hot, a passive warming for example painted on the glass surface, or an automatic shut-off timer to avoid overheating of the glass heating element 422 or reduce energy consumption in the event a user inadvertently fails to turn off the warming drawer, among other things.

With reference to FIGS. 9A-9G, exemplary embodiments of a support plate 442, which can support a glass/ceramic heating element 422 of the warming drawer module 404 (e.g., show in FIGS. 7 and 8), will now be described.

Figures 9A, 9B, 9C:
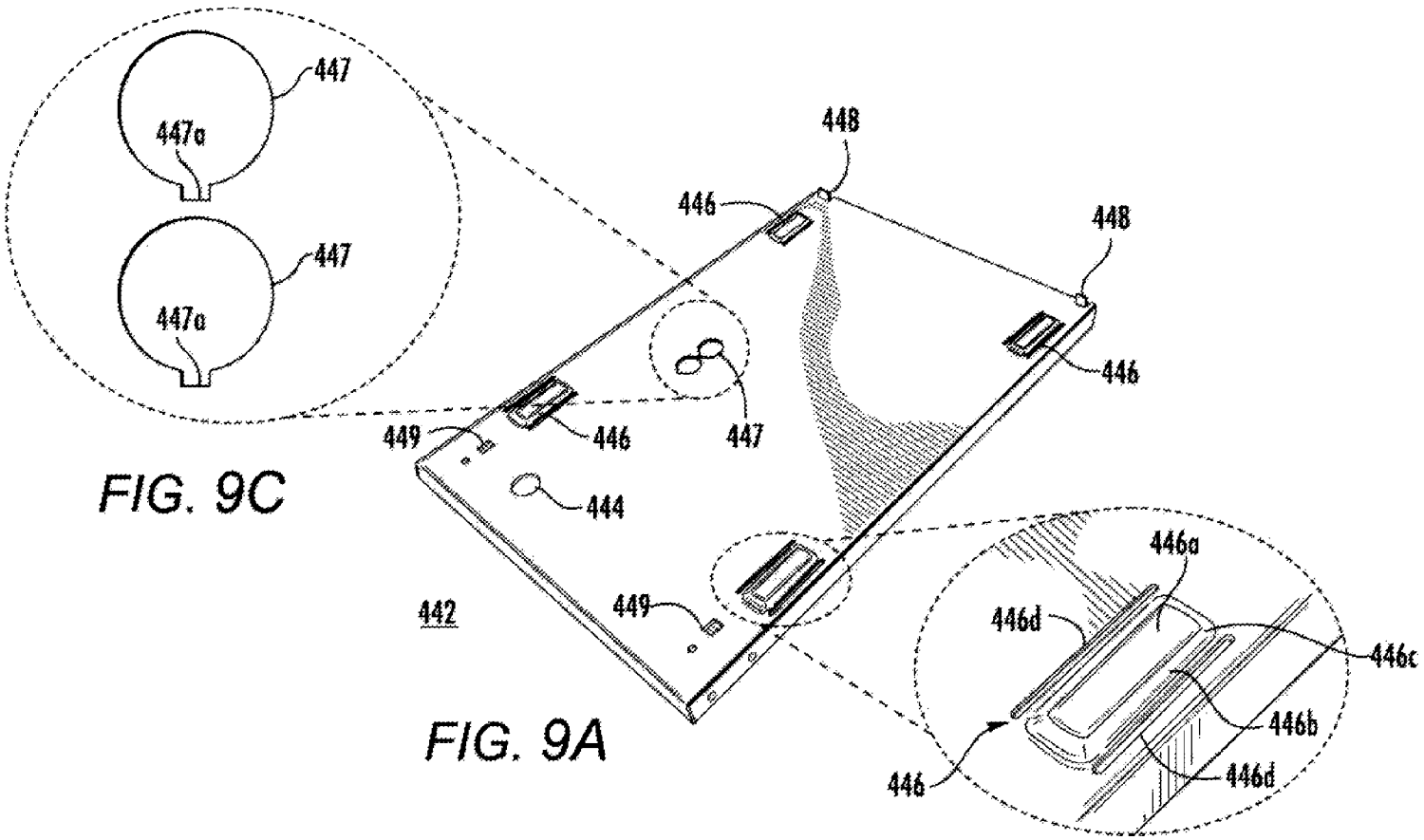
FIG. 9A is a perspective view of a support plate according to an exemplary embodiment of the invention.
FIG. 9B is an enlargement of a portion of the support plate in FIG. 9A.
FIG. 9C is an enlargement of openings in the support plate in FIG. 9A.

As shown in FIG. 9A, an exemplary embodiment of a support plate 442 can include one or more support means (e.g., 446) for simply, easily, and inexpensively supporting an underside of the glass/ceramic heating element 422 such that the element 422 will not be damaged by items loaded on the glass/ceramic heating element 422 of the warming drawer module 404. The support means (e.g., 446) can minimize an amount of thermal and/or electrical contact area between the support means (e.g., 446) and the underside of the glass/ceramic heating element 422. For example, the support means (e.g., 446) can simultaneously minimize an amount of contact between that support means (e.g., 446) and the underside of the glass/ceramic heating element 422, which also may minimize heat transfer away from the glass/ceramic heating element 422 in a downward direction (i.e., in a direction away from the items to be warmed, which is an undesired direction for heat transfer), and which may minimize an amount of contact area of the support plate 442 that will need to be electrically insulated from the conductive underside of the glass/ceramic heating element 422. The support means (e.g., 446) also can control a height of the glass/ceramic heating element 422 above a surface of a support plate 442 (i.e., suspend the heating element 422 above the support plate 442) to provide a predetermined height or clearance for a thermostat 450 and thermostat retainer 460 (e.g. as shown in FIG. 7) to be disposed under the glass/ceramic heating element 422 and in contact with the underside of the glass/ceramic heating element 422. Exemplary embodiments of a thermostat 450 and thermostat retainer 460 will be described in greater detail with reference to FIGS. 10-13D. By controlling the height of the glass/ceramic heating element 422 above the surface of the support plate 442, the support means (e.g., 446) also can provide sufficient space for wire routing between the glass/ceramic heating element 422 and the metal support plate 442, for example, to route the wires 423 of the heating panel 422.

As shown in FIGS. 9A and 9B, an exemplary support plate 442 can include one or more supporting means or features, such as a plurality of embosses 446 for supporting (e.g., evenly and distributively supporting) the underside of the glass/ceramic heating element 422 at a predetermined distance above the support plate 442, while also minimizing thermal and electrical contact areas between the heating element 422 and the support plate 442. The plurality of embosses 446 can be disposed in various arrangements, patterns, and distributions on the support plate 442 to support the heating element 422 depending on the size and shape of the heating element 422. The embosses can be evenly spaced with respect to each other such that the embosses 446 provide equal support for each of the edges of the glass heating element 422 near the corners of the heating element 422, and particularly, for example, in areas in which the frame 416 will clamp down on the glass heating element 422 during assembly, thereby reducing or preventing damage to the glass/ceramic heating element 422, for example, during assembly of the warming drawer module 404. The support plate 442 can include a metal support plate, such as a stainless steel support plate or other suitable heat resistant material, that is capable of being embossed using an emboss tool. In other embodiments, the support plate 442 can be formed from other materials such as, for example, other heat resistant materials that are capable of being formed by embossing, casting, or molding processes.

The support plate 442 also can include one or more features for securing the support plate to other components of the warming drawer module (e.g., 404 in FIG. 7), such as one or more tabs 448 and/or one or more openings or slots 449 for engaging a rear portion and/or front portion of the drawer slides (e.g., 424 shown in FIG. 7). The support plate 442 can include one or more openings 444, for example, for guiding wires (e.g., 423 in FIG. 8) (e.g., power supply lines, control lines, and/or electrical connectors) of the glass/ceramic heating element from the space provided by the embosses 446, for example, to the control panel (e.g., 412 in FIG. 7). The embosses 446 can control a height of the glass/ceramic heating element 422 above a surface of the support plate 442 to provide a predetermined height or clearance for routing the wires between the glass/ceramic heating element and the metal support plate 442. A grommet (not shown) can be provided in the opening 444 to protect the wires from damage or wear from contacting an edge of the opening 444.

FIG. 9B shows an enlargement of an exemplary emboss 446 in FIG. 9A. The emboss 446 can include, for example, an upper surface 446*a* (e.g., having a substantially horizontal planar surface or a rounded surface) for supporting the underside of the glass/ceramic heating element 422, a plurality of side surfaces 446*b* (e.g., tapered or rounded side surfaces), and a plurality of tapered or rounded corners 446*c*. The embosses 446 of the support plate can have a variety of shapes and/or profiles that are capable of supporting the underside of the glass heating element 422.

With reference to FIGS. 9A and 9C, the support plate 442 can include one or more openings 447 configured to receive or engage one or more thermostat retainers 460 that support and fix one or more thermostats 450 (described in greater detail with reference to FIGS. 10-13D) in the space provided by the embosses 446 and in a predetermined position and height above the surface of the support plate 442 such that the thermostat 450 is against the underside of the glass heating element (e.g., 422 in FIG. 8). The opening 447, for example as illustrated in FIG. 9C, can include a circular opening having one or more notches or key cutouts 447*a* (hereinafter "key cutouts") formed in a perimeter of the opening to engage a corresponding feature of a thermostat retainer (e.g. 460 described with reference to FIGS. 10-13D below) and limit or prevent rotation of the thermostat retainer in the opening 447. As shown in the examples illustrated in FIGS. 9D-9G, the opening 447 can include a plurality of key cutouts 447*a*, 447*b* formed in a perimeter of the opening at a variety of positions to engage a plurality of corresponding features of a thermostat retainer and limit or prevent rotation of the thermostat retainer in the opening 447. The opening 447 can include any number of key cutouts, such as one, two, three, etc., which can be disposed as a variety of locations around the perimeter of the opening 447 for engaging corresponding features on a thermostat retainer to prevent rotation.

In other embodiments, for example when more than one type of thermostat and/or retainer is being used, the arrangement of the cutouts (e.g., 447*a*, 447*b*) can be different for one or more openings 447 and the corresponding key features of one or more thermostat retainers also can be different, for example, based on a type of thermostat. In this way, one or more of the openings 447 can be configured to correspond only to a particular key arrangement of a particular thermostat retainer, thereby ensuring that each respective thermostat can only be installed in a single, correct location on the support plate 442 and simplifying the manufacturing process.

The exemplary embodiments are not limited to arrangements in which the opening 447 has key cutouts 447*a*, 447*b* for preventing rotation of the thermostat retainer. In other embodiments, one or more openings 447 can have other perimeter shapes, for example, that can limit or prevent rotation of a corresponding thermostat retainer by virtue of their shape and without a key cutout 447*a*, 447*b*. For example, an opening 447 can have a perimeter shape that is oval, rectangular, square, hexagonal, etc. that will prevent a correspondingly-shaped thermostat retainer 460 from rotating in the opening 447, thereby fixing the position of the thermostat 450 with respect to the opening 447 of the support plate 442 without additional corresponding key features formed on the thermostat retainer 460 and/or the opening 447.

Figure 11B:
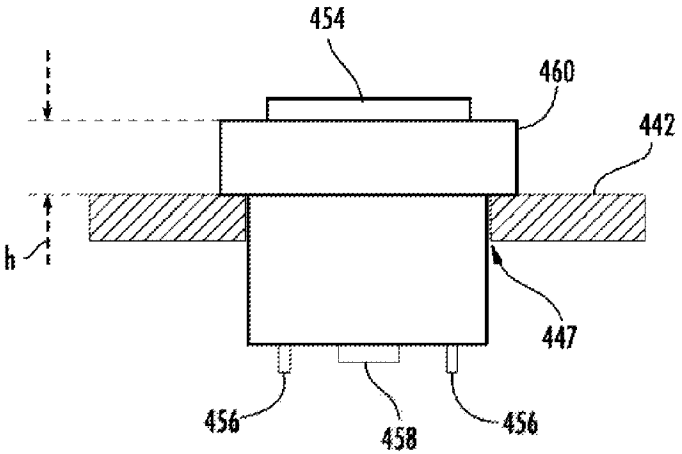
FIG. 11B is a side view of the assembly of the thermostat and thermostat retainer of FIG. 11A in an opening of a support plate according to an exemplary embodiment of the invention.
Figure 10:
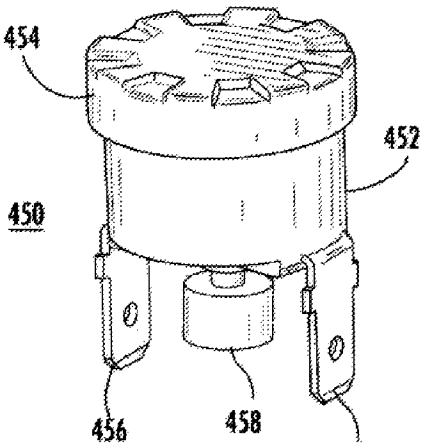
FIG. 10 is a perspective view of a thermostat according to an exemplary embodiment of the invention.

With reference to FIGS. 10-11B, exemplary embodiments of a thermostat and thermostat retainer will now be described.

Figure 11A:
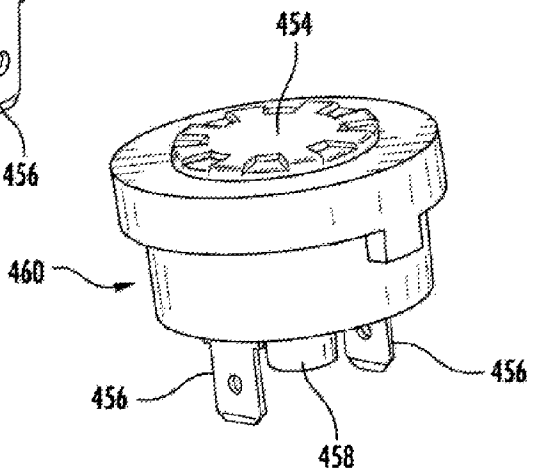
FIG. 11A is a perspective view of an assembly of a thermostat and thermostat retainer.

FIG. 10 illustrates an example of a thermostat 450 (e.g., off-the-shelf thermostat) that may be suitable for measuring the temperature of a heating element for a warming drawer. The thermostat 450 may include a cylindrical body 452 and a sensor 454 (i.e., temperature sensing surface) on an end of the body 452. A pair of electrical terminals 456 extend from an opposite side of the body 452 from the sensor 454. The thermostat 450 can include a manual reset button 456 extending from the opposite side of the body 452 from the sensor 454 and being disposed between the terminals 456. The sensor 454 can have a larger diameter than the cylindrical body 452. FIG. 11A illustrates an example of an assembly of a thermostat 450 and a thermostat retainer 460 according to the exemplary embodiments. FIG. 11B illustrates an example of the assembly of the thermostat 450 and the thermostat retainer 460 of FIG. 11A disposed in an opening 447 of the support plate 442 to accurately position, support, and fix the thermostat 450 in a predetermined position or height h with respect to the support plate 442 and/or the underside of the glass/ceramic heating element 422.

Figure 12A:
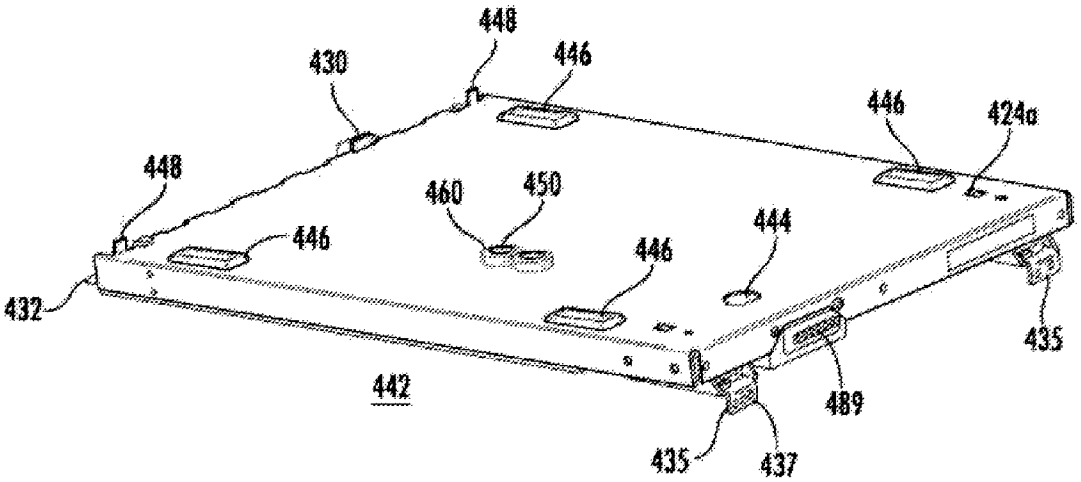
FIG. 12A is a perspective view of a support plate.

As shown in FIG. 12A, one or more thermostats 450 can be positioned on the support plate 442 using thermostat retainers 460 disposed in openings (e.g., 447 in FIGS. 9A and 11B) in the support plate 442 such that the thermostat 450 and retainer 460 are prevented by the retainer 460 from rotating about the longitudinal axis of the thermostat 450. The support plate 442 can includes a plurality of embosses 446 for supporting the underside of the glass/ceramic heating element (e.g., 422 in FIGS. 7 and 8) at a predetermined distance above the support plate 442, while also minimizing thermal and electrical contact areas between the heating element 422 and the support plate 442. The thermostat 450 is disposed in the space between a surface of the support plate 442 and an underside of the glass/ceramic heating element (not shown in FIG. 12A; see 422 in FIG. 8), and in thermal contact with the bottom surface of the glass/ceramic heating element 422 in order to monitor the temperature of the glass heating element 422 and provide a signal to a control unit of the warming drawer 404 for limiting or regulating the temperature of the heating element 422. The thermostat 450 can monitor the temperature of the glass heating element 422 to permit the control unit, for example of a control panel of the heating element 422, to control the operation of the heating element 422 (e.g., ON and OFF operation) in order to provide the selected temperature setting. An accurate determination of the true temperature of the heating element 422 can permit the control unit to consistently and accurately heat the heating element 422 to the selected temperature setting from one use to another use. In this way, a user can accurately select an appropriate temperature setting with an expectation that the warming drawer will function and heat the items to be warmed consistently from one use to the next use.

As shown in FIG. 12A, the support plate 442 can include one or more openings 444 for passing one or more wires, for example, from the heating element to a wire guide or channel on an underside of the support plate 442 and an electrical connection 489 (e.g., a wiring harness connector such as a 6-pin connector). The electrical connection 489 can be connected, for example, to a corresponding electrical connection leading to a control unit (e.g., 412 in FIG. 7) in a front panel (e.g., 406 in FIG. 7) for controlling the heating element. FIG. 12A also shows some of the features for assembling the warming drawer shown in FIG. 7, such as a locking feature 432 at a rear portion of a U-shaped channel (e.g., 426 in FIG. 7) that engages or locks into a corresponding locking features (not shown) in the rear wall of the warming drawer housing (shown in FIG. 7), a front portion 435 of the U-shaped channel having openings 437 that can be secured (for example, with one or more screws) to a portion of the warming drawer housing at a location that is accessible to a user or technician from the front of the appliance in order to facilitate easy removal and replacement of the warming drawer module (e.g., 404 in FIG. 7) for repairs, replacement, modifications, and/or cleaning of the warming drawer module, and one or more tabs 448 for engaging a rear portion of a pair of drawer slides (e.g., 424 in FIG. 7).

Figure 12B:
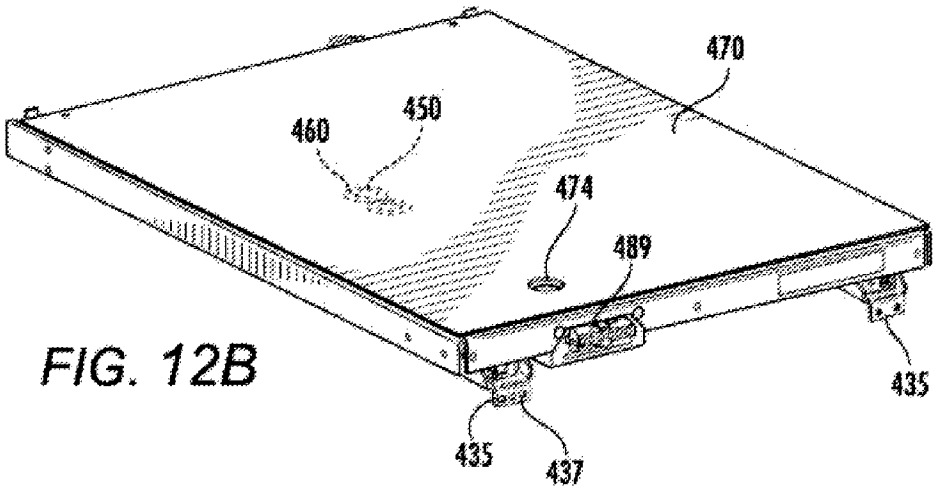
FIG. 12B is a perspective view of a support plate having a thermally conductive sheet, according to an exemplary embodiment of the invention.

As shown in FIG. 12B, after the thermostat 450 and thermostat retainer 460 are installed on the support plate 442, a thermally conductive layer, such as a thermally conductive sheet 470, can be disposed over the entire support plate 442, including the sensor 454 of each thermostat 450, or at least the contact points between the thermostats 450 and/or the plurality of embosses 446, to thereby improve a thermal contact between the sensor 454 of each thermostat 450 and the underside of the heating element 422, and ensuring an accurate determination of a true temperature of the heating element 422. The thermally conductive layer can be formed from a material having low thermal resistance (i.e., thermally conductive). The material forming the thermally conductive layer also advantageously can have high electrical resistance qualities, thereby electrically insulating each of the plurality of embosses from the underside of the electrically conductive underside of the heating element 422. The thermally conductive sheet 470 or thermally conductive tape 472 can include, for example, UL (Underwriter Laboratories) listed silicone electrically insulating material. The sheet 470 can include one or more openings 474 corresponding to one or more openings on the support plate 442, such as one or more openings 444 for passing the wires from the heating element to a wire guide or channel on an underside of the support plate 442.

Figure 13B:
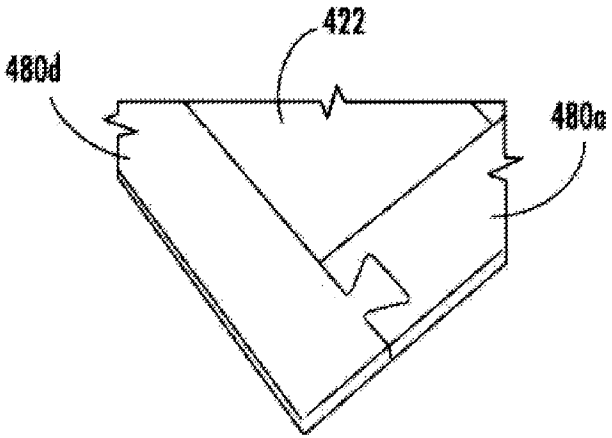
FIGS. 13A and 13B are perspective views of a support plate having a plurality of gasket strips according to an exemplary embodiment of the invention.
Figure 13A:
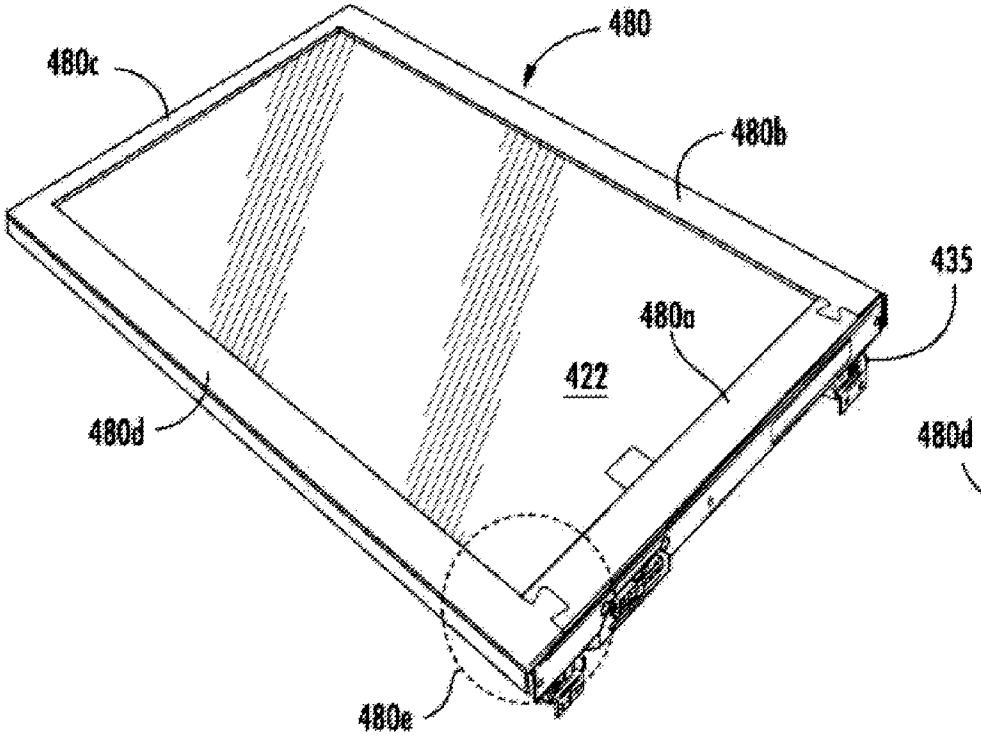

With reference to FIGS. 13A and 13B, the ceramic/glass heating element 422 can be disposed directly on the thermally conductive sheet 470. An upper edge or perimeter surface of the glass heating element 422 can be covered by one or more gasket strips 480 for preventing spills, liquids, or other contaminants from passing between the glass heating element 422 and the frame 416 (shown in FIGS. 14A and 14B).

Figure 14A:
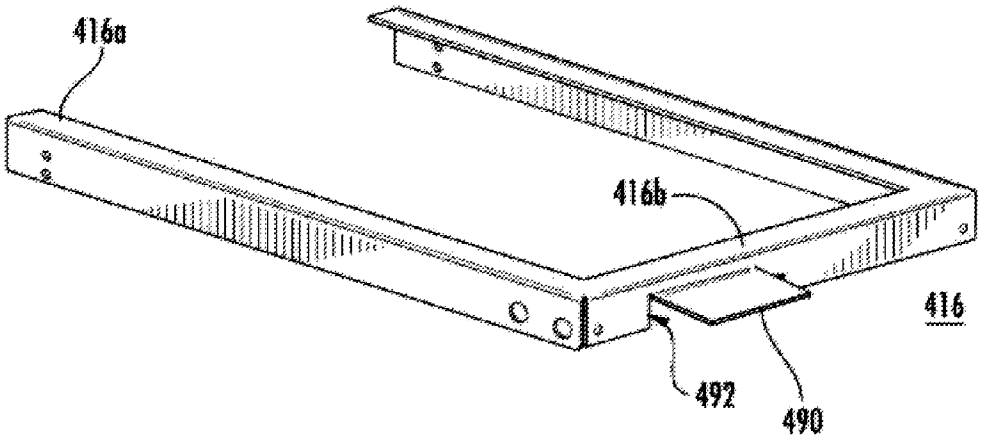
FIGS. 14A and 14B are perspective and side views, respectively, of a frame according to an exemplary embodiment of the invention.
Figure 14B:
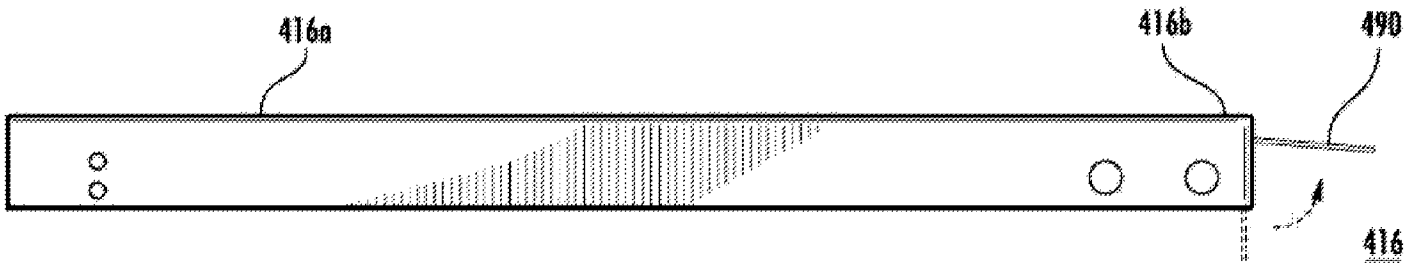

As shown in FIGS. 14A and 14B, the frame 416 can include, for example, side portions 416*a* and a front portion 416*b*. The front portion 416*b* can include an integral drip guard 490, which will be described in greater detail.

Figure 15:
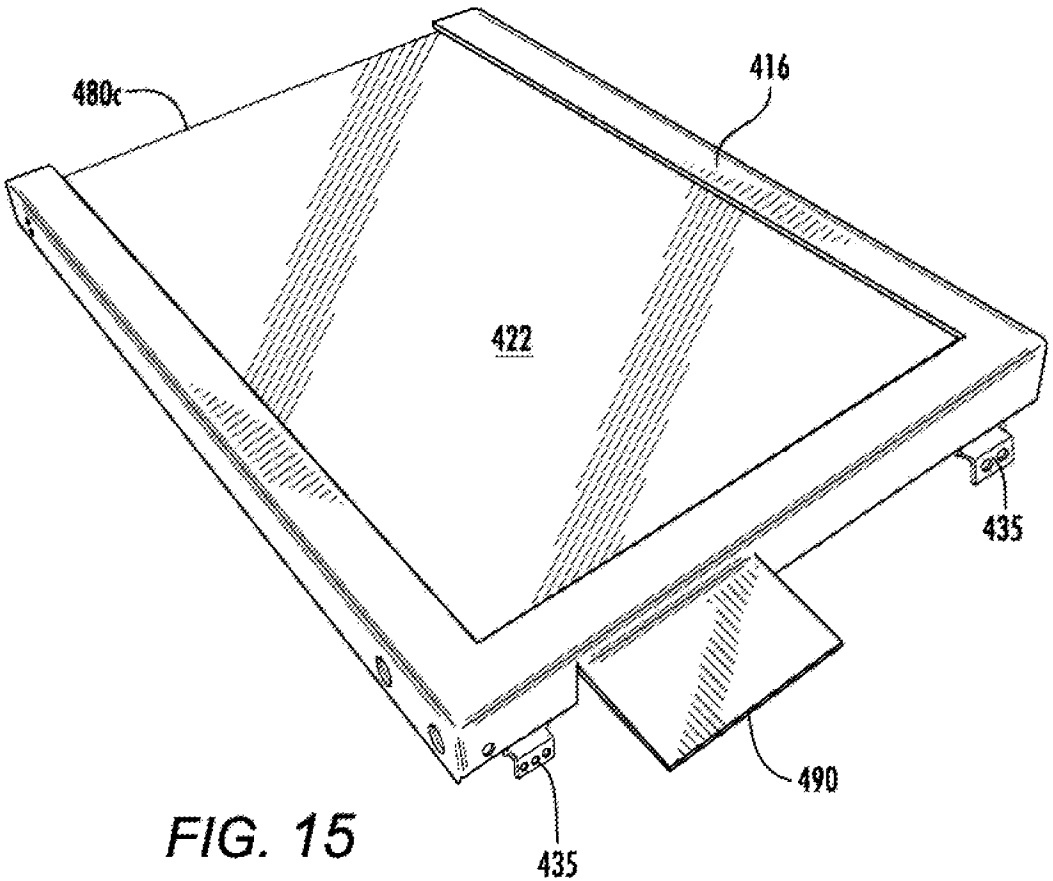
FIG. 15 is a perspective view of a frame and heating element assembly according to an exemplary embodiment of the invention.
Figure 16:
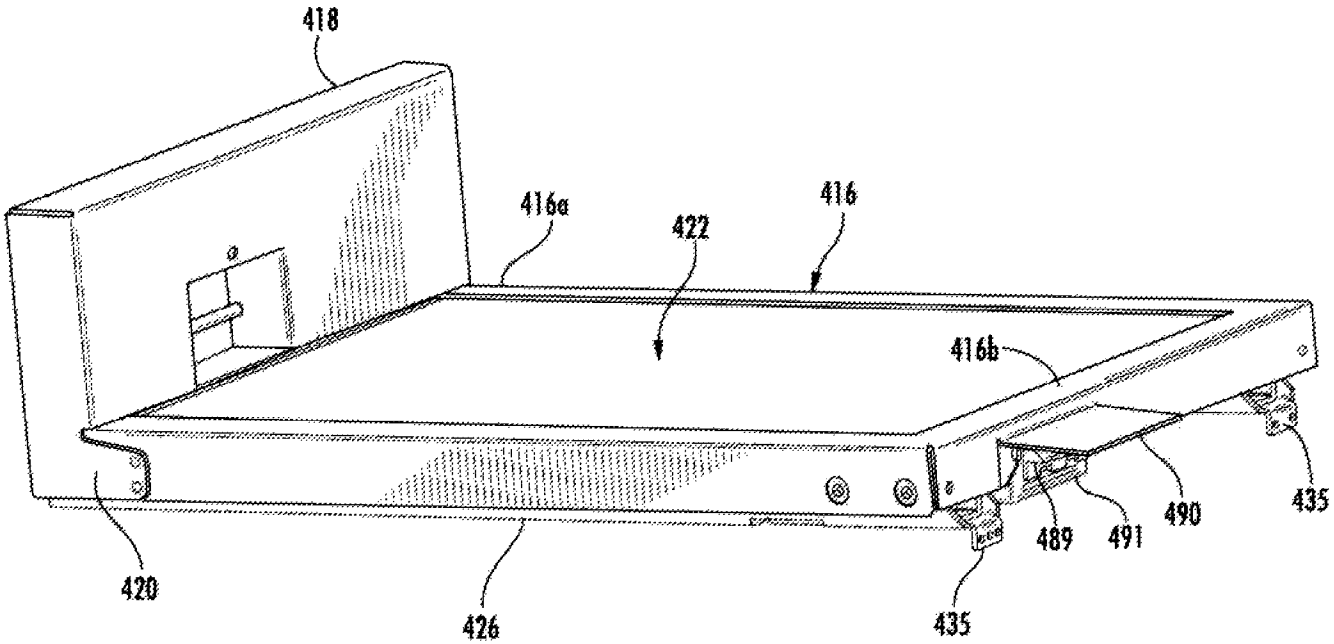
FIG. 16 is a perspective view of a frame and heating element assembly according to an exemplary embodiment of the invention.

As shown in FIGS. 15 and 16, the frame 416 can be disposed over the gasket strips 480 (shown in FIGS. 13A and 13B) and the glass heating element 422, and then secured to the support plate 442 (shown in FIGS. 13A and 13B). A rear panel 418 may be disposed over a rear strip of the gasket strips 480 and coupled to the side portions 416*a* of the frame 416, for example, via the bracket portions 420, which may be separate pieces or integrally formed with the rear portion 418. In this way, the glass heating element 422 can form both a floor surface of the warming drawer module 404 and the heating surface of the warming drawer module 404, and the gasket strips can keep spills or other liquids away from electrical components in the module 404, and such that the items to be warmed can be placed directly on the glass heating element 422 when the warming drawer 404 is deployed. As shown in FIG. 16, the warming drawer module can include a wire guide 491 (coupled to an underside of the support plate 442 as shown in FIG. 12A) for guiding one or more wires/cables from, for example, the thermostats 450, the heating element 422, or other electrical components to the interior of the front panel 406 and the control panel 412. A wiring harness connector 489 can be disposed at an end of the wire guide 491. The frame 416 can include a drip guard 490 to protect the wiring harness connector 489 from spills, liquids, or other contaminants that may drain or run off of the glass heating element 422 or frame 416 during use. For example, the drip guard 490 can guide spills, cleaning solutions, etc. from the upper surface of the glass heating element 422 and the frame 416 away from and around a first electrical connector (such as a first wiring harness connector 489) in the wire guide 491 of the support plate 442, which may be disposed at an end of the wire guide 491, and a second electrical connector (such as a second wiring harness connector) in the front panel 406 that leads to the control panel 412, and/or away from the electrical components above or below the support plate 442 or on the glass heating element 422. FIGS. 15 and 16, respectively, also show the U-shaped channel 426 that engages or locks into a corresponding locking features (not shown) in the rear wall of the warming drawer housing, and a front portion 435 of the U-shaped channel 426 that can be secured (for example, with one or more screws) to a portion of the warming drawer housing at a location that is accessible to a user or technician from the front of the appliance in order to facilitate easy removal and replacement of the warming drawer module for repairs, replacement, modifications, and/or cleaning of the warming drawer module.

Figure 17:
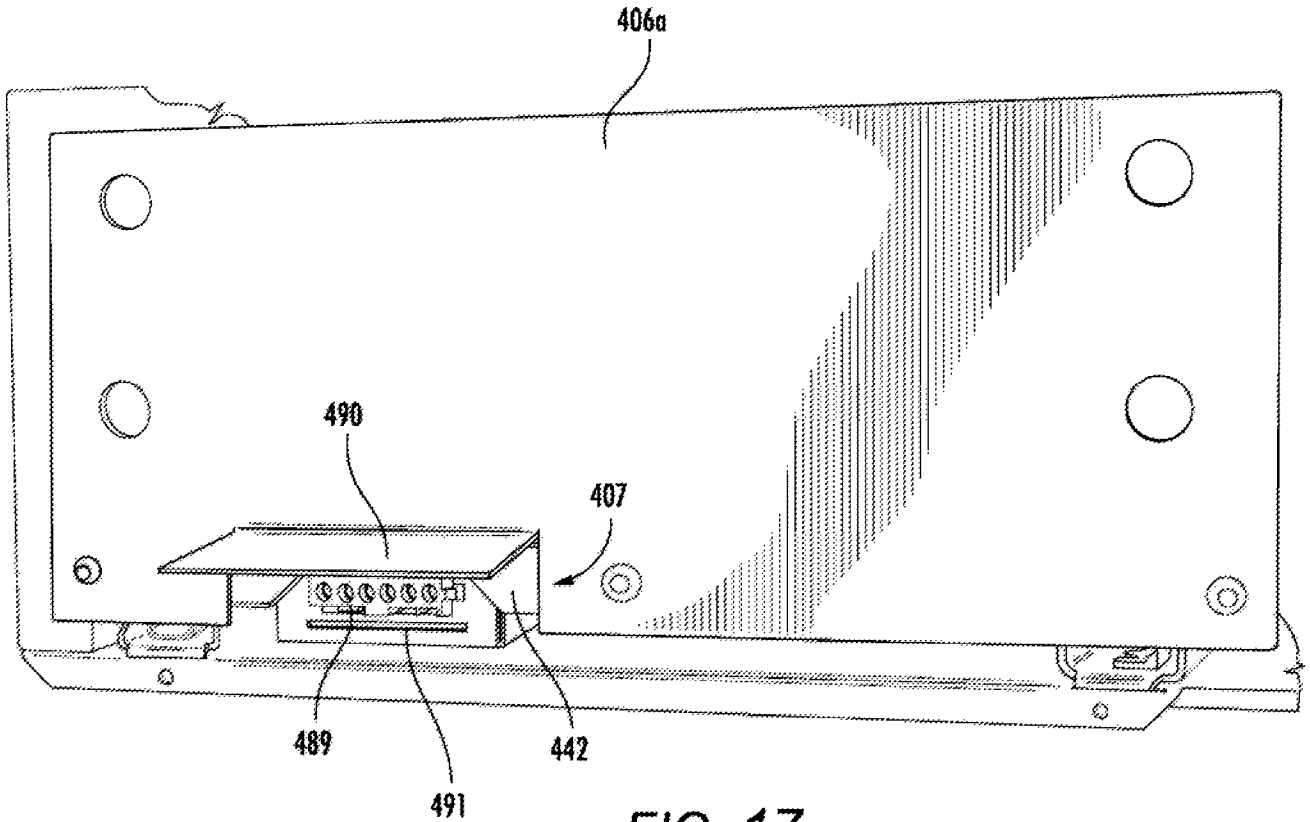
FIG. 17 is a perspective, front view of a mounting plate/rear cover of the front panel and frame assembly having a drip guard according to an exemplary embodiment of the invention.

As shown in FIG. 17, a mounting plate or rear cover 406*a* of the front panel (406 shown in FIG. 18) can be coupled to the frame such that the drip guard 490 covers the outlet of the wire guide 491 and the wiring harness connector 489 disposed therein.

Figure 18A:
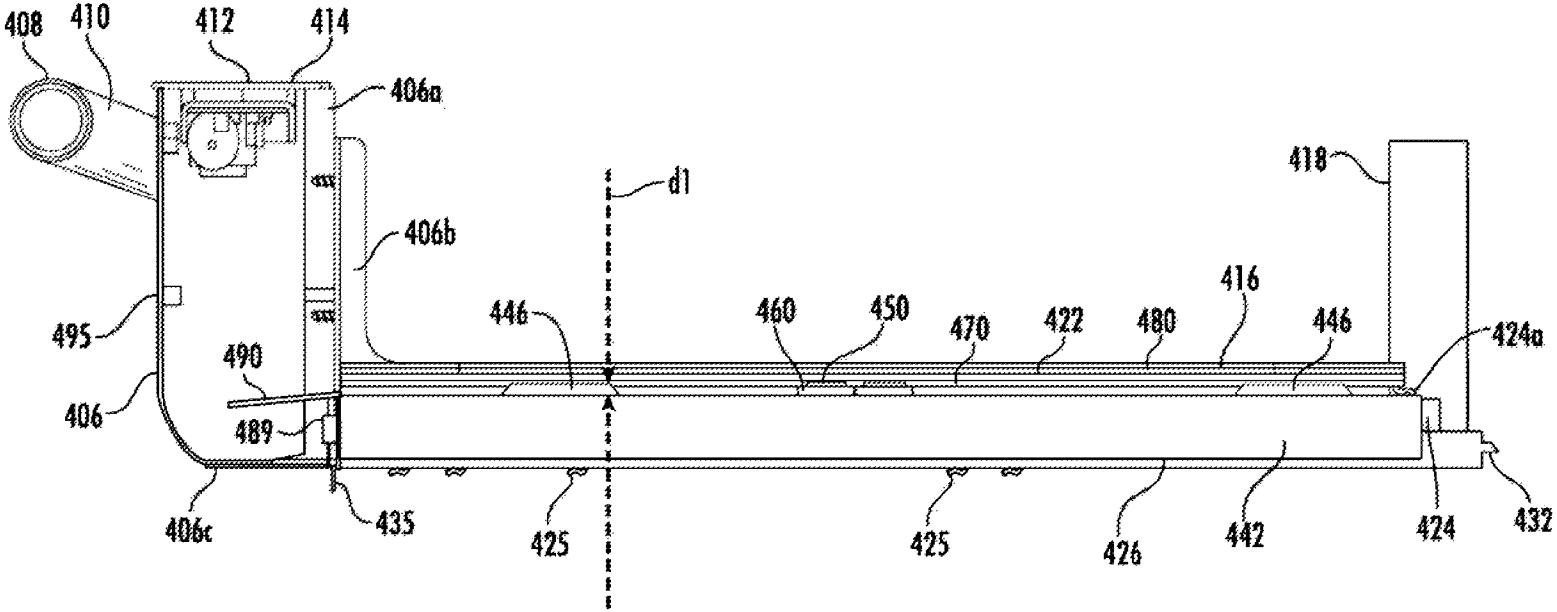
FIG. 18A is a schematic, cut-away side view of a warming drawer module according to an exemplary embodiment of the invention.
Figure 18B:
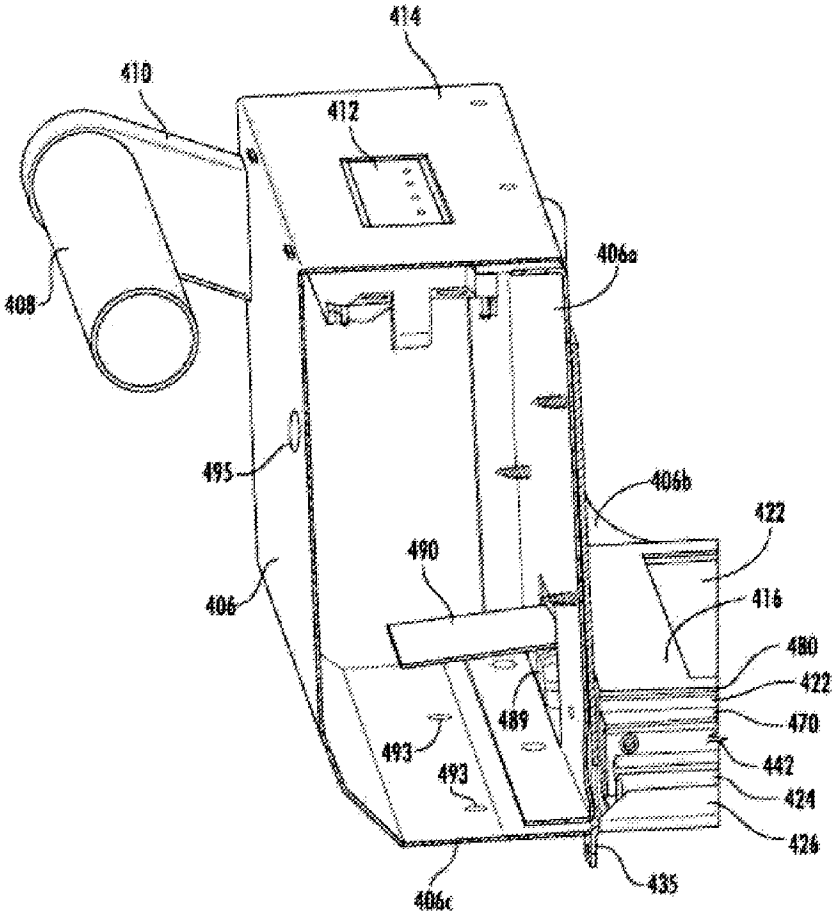
FIG. 18B is a schematic, cut-away partial side view of a front panel area of a warming drawer module according to the exemplary embodiment of FIG. 18A.

FIG. 18A illustrates a side, cut-away view of an assembled warming drawer module 404 according to the exemplary embodiment. FIG. 18B is an enlargement the front of the warming drawer module illustrated in the embodiment of FIG. 18A.

As shown in FIG. 18A, the assembled warming drawer module 404 can include a front panel 406 having a handle 408 coupled to the front panel 406 via handle mounts 410. The front panel 406 optionally can include a control panel 412 disposed in an opening or recess in an upper surface 414 of the front panel 406, and as another option, one or more indicator lights 495 (e.g., an LED indicator light) on a front surface of the front panel 406 to indicate when the warming drawer 400 is in operation, when the heating element is hot, etc. The front panel 406 can include a mounting plate or rear cover 406*a* that encloses a rear side of the front panel 406 and a bracket 406*b* for coupling the mounting plate or rear cover 406*a* to a front portion of a frame 416 of the warming drawer module 404. A rear panel 418 can be coupled to a rear portion of the frame 416. A drawer slide 424 can be coupled to a support plate 442 (e.g., stainless steel support plate), and particularly, for example, to the underside of the support plate 442. In the illustrated example, the drawer slide 424 can include one or more projections 424*a* that engage corresponding openings (not shown in FIG. 18A) in the support plate 442. The channel 426 can be coupled to an underside of the slide 424. For example, the slide 42 can include one or more projections 425 on an underside of the slide 424 that engage corresponding openings in the U-shaped channel 426. FIG. 18A shows the locking feature 432 at a rear portion of the U-shaped channel 426 that engages or locks into a corresponding locking features (not shown) in the rear wall of the warming drawer housing, and a front portion 435 of the U-shaped channel 426 that can be secured (for example, with one or more screws) to a portion of the warming drawer housing at a location that is accessible to a user or technician from the front of the appliance in order to facilitate easy removal and replacement of the warming drawer module 404 for repairs, replacement, modifications, and/or cleaning of the warming drawer module 404.

As shown in FIGS. 18A and 18B, the exemplary warming drawer 400 can include a glass heating element 422 supported by a plurality of embosses 446 formed on the support plate 442. The glass heating element 422 can be supported by the plurality of embosses 446 at a predetermined distance d1 above the support plate 442, thereby minimizing thermal and electrical contact areas between the heating element 422 and the support plate 442. The warming drawer 400 can include one or more thermostat retainers 460 that support and fix one or more thermostats 450 such that a portion of each retainer 460 and the sensor of each thermostat 450 is disposed within the predetermined distance d1 between the upper surface of the support plate 442 and the underside of the glass heating element 422, which is provided by the embosses 446. A thermally conductive sheet 470 can be disposed between the thermostat 450 and the underside of the glass heating element 422. The glass heating element 422 can be disposed over the thermally conductive sheet 470, the plurality of embosses 446 of the support plate 442, and the thermostats 450. The wires (not shown) of the heating element 422 can be guided in the space between the upper surface of the support plate 442 and the underside of the glass heating element 422. An upper edge or perimeter surface of the glass heating element 422 can be covered by one or more gasket strips 480 for spills or liquids, which may form a gasket or seal between the glass heating element 422 and the frame 416. The frame 416 can be disposed over the gasket strips 480 and the glass heating element 422, and then secured to the support plate 442, thereby keeping spills or other liquids away from electrical components in the module 404.

With reference again to FIGS. 18A and 18B, the wires (not shown) of the heating element 422 can be guided in the space between the upper surface of the support plate 442 and the underside of the glass heating element 422 to an opening (not shown in FIG. 18A; see 444 in FIGS. 9A, 12A and 12B) for passing the wires from the heating element to a wire guide or channel on an underside of the support plate 442 and to an electrical connection 489 in an interior of the front panel 406. The electrical connection 489 can be connected, for example, to a corresponding electrical connection leading to a control unit 412 in the upper surface 414 of the front panel 406 for controlling the heating element.

With reference again to FIGS. 14A-18B, an exemplary embodiment of means (e.g., 490) for guiding spills, liquids, or other contaminants on the warming drawer module away from electrical components will now be described. The exemplary embodiments also can provide means for draining (e.g., 493) such spills or liquids from the warming drawer module.

More particularly, the warming drawer module can include a support plate 442 supporting the ceramic/glass heating element 422. The warming drawer module further can include one or more gasket strips 480 covering an upper edge or perimeter surface of the ceramic/glass heating element 422, which may be directly exposed to the spills, liquids, or other contaminants. A frame 416 can be disposed over the gasket strips 480 and the glass heating element 422, and then secured to the support plate 442, thereby providing a seal between the ceramic/glass heating element 422 and the frame 416 and preventing spills or liquids from entering the space, which may include electrical components, between the ceramic/glass heating element 422 and the frame 416 at the intersection of the ceramic/glass heating element 422 and the frame 416.

The arrangement of the warming drawer and the seal (e.g., 480) between the ceramic/glass heating element 422 and the frame 416 may result in a spill, liquid, or other contaminant on the ceramic/glass heating element 422 and/or the frame 416 having nowhere to go, and therefore, running over the edge of the frame 416 and down a side of the frame 416. If such spills or liquids run off or drip off the side edges (e.g., 416*a*) of the frame 416 (i.e., the side edges connecting the front panel 406 to the rear panel 418 of the warming drawer), then the spills, liquids, or other contaminants simply may fall onto the floor without coming into contact with any electrical components (e.g., 489) in the warming drawer module. If such spills, liquids, or other contaminants run off or drip off of a front edge (e.g., 416*b*) of the frame 416, for example, where a front panel 406 (which includes the control panel 412) abuts the front portion 416*a* of the frame 416*a*, then there may be a higher risk that part or all of a spill, liquid, or other contaminant may run into an area where electrical components or connections (e.g., wiring harness connector 489 such as a 6-pin connector or the like) of the heating element 422, thermostats 450, control wires/cables, and/or power supply wires/cables are coupled to one or more corresponding electrical components or connections of the front cover 406, which includes the control panel 412 for controlling an operation of one or more of these electrical components.

As shown in FIGS. 14A-18B, an exemplary embodiment is directed to means (e.g., 490) for guiding or channeling spills, liquids, or other contaminants away from electrical components and connections (e.g., wiring harness connectors 489) of the warming drawer module, and more particularly, away from electrical components and connections (e.g., wiring harness connectors 489) in a front area of the warming drawer module where the front panel 406 abuts the frame 416, and where electrical components or connections (e.g., wiring harness connectors 489) of the heating element 422, thermostats 450, control wires/cables, and/or power supply wires/cables are coupled to one or more corresponding electrical components or connections of the front cover 406 (which may include the control panel for controlling an operation of one or more electrical components of the warming drawer module). In this manner, the exemplary embodiments can minimize or prevent a risk of damage, electrical grounding, etc. of the electrical components or connections of the warming drawer due to spills, liquids, or other contaminants.

In an exemplary embodiment, the warming drawer module can include a drip guard 490, for example on a front portion 416*b* of the frame 416, for guiding or channeling spills, liquids, or other contaminants away from electrical components and connections of the warming drawer module, and more particularly, away from electrical components and connections (e.g., a wiring harness connector 489) in a front area of the warming drawer module where the front panel 406 (which includes the control panel 412 for controlling an operation of one or more electrical components of the warming drawer module) abuts the frame 416, and where electrical components or connections (e.g., wiring harness connector 489) of the heating element 422, thermostats 450, control wires/cables, and/or power supply wires/cables are coupled to one or more corresponding electrical components or connections (not shown) of the front cover 406.

The drip guard 490 can be configured to extend from a front portion 416*b* of the frame 416, for example, at a location corresponding to (i.e., above) a wiring harness connector 489 for connecting the electrical components of the warming drawer floor assembly with electrical components (not shown) of a front panel assembly. The drip guard 490 can function, for example, in a manner similar to an eave on a house by guiding spills, liquids, or other contaminants over and away from the wiring harness connector 489 and, for example, to a lower surface 406*c* of the front panel 406. The drip guard 490 can overhang and extend past the wiring harness connector 489 such that any spills, liquids, or other contaminants on the ceramic/glass heating element 422 and/or frame 416 that may run off are guided away from, and do not enter or contact, the electrical wiring harness connector 489.

The drip guard 490 can be formed as a single piece integrated into the frame 416 (e.g., a stainless steel frame) used to secure and seal the ceramic/glass heating element 422 to the support plate 442. For example, in an exemplary embodiment, a drip guard 490 can be formed by cutting (for example, at one or more cut locations 492 in FIG. 14A) a portion of the frame 416, for example, that is substantially perpendicular to a surface of the heating element 422 at a location corresponding to (i.e., above) a predetermined location of the wiring harness connector 489 to be protected from spills, and then bending (see arrow in FIG. 14B) the cut portion until the cut portion is disposed at an angle extending outward from the frame 416 (i.e., at an angle other than perpendicular to the surface of the glass heating element), thereby forming the drip guard 490. In this way, a so-called "eave" or drip guard 490 can be formed for protecting an underlying electrical connection or wiring harness connector 489 from spills, liquid, or other contaminants that may run off of a warming surface of the warming drawer module. The drip guard 490 can be disposed, for example, at an angle with respect to the surface of the ceramic/glass heating element 422 in which the drip guard 490 is sloped in a downward direction away from the upper surface of the frame 416 and/or glass heating element 422 (such as a 10 degree angle, 30 degree angle, 45 degree angle, or other angle) to drain a spill, etc. running off of these components. Other embodiments of the drip guard 490 can include a lip, raised edge, or folded edge formed on one or more edges to assist with guiding/channeling a spill along the drip guard 490, and/or a side portion extending downward from one or more edges of the drip guard 490 to provide further protection for electrical components disposed underneath or adjacent to the drip guard 490.

With reference again to FIG. 14B, in an example embodiment, the sheet metal used to form the frame 416 can be stamped or cut to include a larger portion at a location where the drip guard will be formed, such that when the drip guard is formed a length of the drip guard 490 is larger than a height as the remainder of the edge of the frame 416 and the drip guard 490 extends a larger distance away from an upper surface of the frame 416 than the edges of the frame 416. The cut at each cut location 492 can extend along an entire height of the edge of the frame 416 or a part of the height of the edge of the frame 416, as shown for example in the embodiment illustrated in FIGS. 14A and 14B, such that the drip guard 490 projects outward from the edge of the frame 416 and is not flush with an upper surface of the frame 416. In other embodiments, the portion of the frame 416 used to form the drip guard 490 can be a uniform height as the remainder of the edge of the frame 416, such that a length of the drip guard 490 corresponds to a height of the edge of the frame 416.

With reference to FIGS. 17-18B, in an embodiment, the drip guard 490 can extend into a space within a front panel 406 of the warming drawer, for example, which includes the control unit for controlling the warming drawer and electronics of the control panel 412. For example, the frame 416 and/or the support plate 442 can be coupled to the front panel 406 via a mounting plate or rear cover 406*a* that encloses a rear side of the front panel 406. As shown in FIG. 17, the drip guard 490 can be configured to extend through an opening or notch 407 formed in the mounting plate or rear cover 406*a* such that the drip guard 490 can extend into a space within the front panel 406 of the warming drawer in an assembled state (as shown in FIG. 18A). The electrical wiring harness connector 489 also can be configured to be disposed in the opening or notch 407 in the mounting plate or rear cover 406*a* such that the wiring harness connector 489 is accessible and connectible to a corresponding wiring harness connector of the front panel 406. As shown in FIG. 17, a portion of the support plate 442, an end of the wire guide 491, and the wiring harness connector 489 can be exposed by or accessible through the opening 407 in the mounting plate or rear cover 406*a*.

With reference to FIG. 18B, the drip guard 490 can be configured to guide the spill, etc. to an area of the warming drawer module optionally having one or more drain holes 493 that permit the spill, etc. to pass safely out of the warming drawer module. For example, as show in FIG. 18B, the front panel 406 of the warming drawer module can include a lower portion 406*c* having one or more drain holes 493 that permit the spill, etc. to drain safely out of the warming drawer module.

In another exemplary embodiment, the drip guard 490 can be configured to guide the spill, etc. to an area of the warming drawer module having a reservoir or drain pan (e.g., formed by a shape of the lower portion 406*c* or by a structure (not shown) in the lower portion 406*c*) for collecting or holding the spill, etc. until the spill, etc. can evaporate over time, or until the spill, etc. can drain through one or more drain holes 493.

In this manner, the exemplary embodiments can provide a simple, cost effective, and reliable means for minimizing or preventing a risk of damage, electrical grounding, etc. of the electrical components or connections of the warming drawer due to spills, liquids, or other contaminants. The exemplary embodiments can provide a drip guard (e.g., 490) with minimal additional manufacturing and without requiring additional components or pieces. The exemplary embodiments can provide a drip guard (e.g., 490) that reliably minimizes or prevents spills, liquids, or other contaminants from contacting electrical components using a single, integral feature that does not require additional steps or materials to seal the drip guard, such as caulking or adhesives.

Figure 19B:
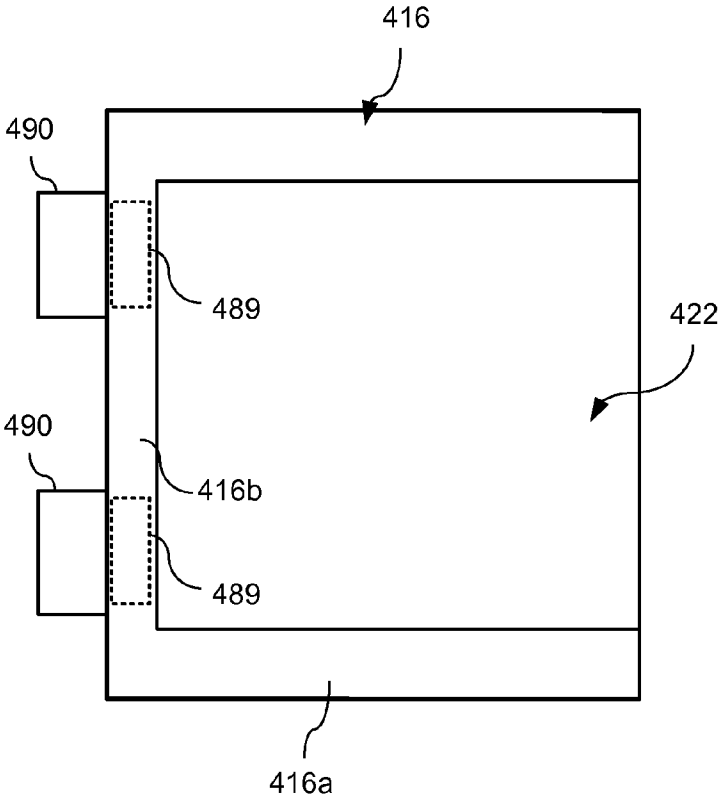
FIGS. 19A and 19B are plan views of frame having a drip guard according to exemplary embodiments of the invention.
Figure 19A:
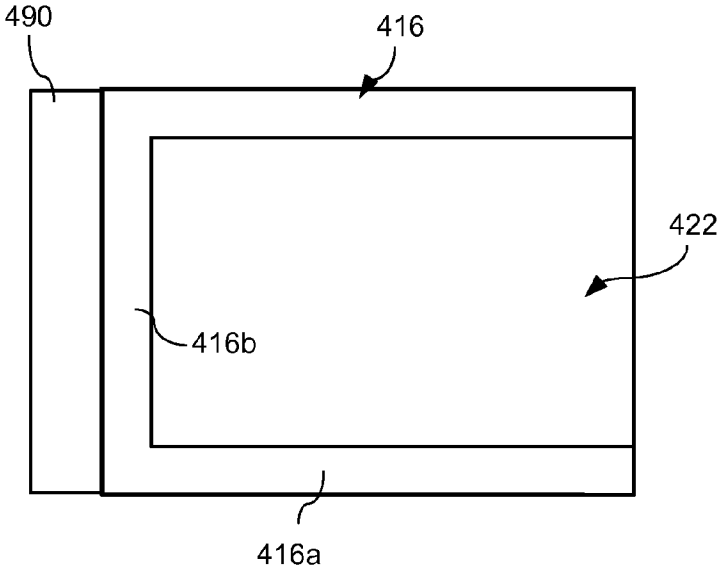

With reference to FIG. 19A, in another exemplary embodiment, the drip guard 490 can be configured to extend along substantially all of the front edge (e.g., 416*b*) of the frame 416 or along the entire front edge of the frame 416, thereby ensuring that the electrical components or connections 489 for connecting the electrical components of the floor assembly of the warming drawer module with electrical components of a front panel assembly are protected from spills, liquids, or other contaminants.

With reference to FIG. 19B, in another exemplary embodiment, a plurality of drip guards 490 can be configured to extend from the edge of the frame 416 at locations above a plurality of electrical components or connections 489, thereby individually protecting respective electrical components or connections from spills, liquids, or other contaminants.

Figure 20:
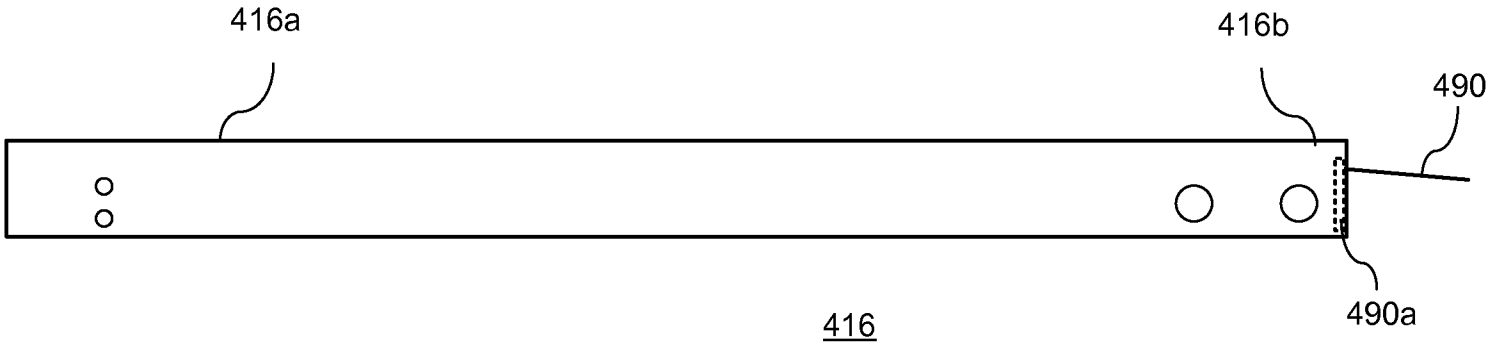
FIG. 20 is a side view of frame having a drip guard according to an exemplary embodiment of the invention.

With reference to FIG. 20, in another exemplary embodiment, the drip guard 490 can be formed from a separate piece or part that is coupled to, for example, the frame 416, the interior of the front panel 406, or the mounting plate or rear cover 406*a* of the front panel 406. For example, the drip guard 490 can include a base portion 490*a* that is inserted through an opening or cutout in the edge of the frame 416 and coupled to the frame 416 such that the spill, etc. cannot pass behind the drip guard 490 and is guided along the slope of the drip guard 490.

An exemplary drain guard 490 can be formed, for example, from stainless steel particularly in instances when the drip guard 490 is formed from a portion of the frame 416 (i.e., stainless steel frame). In other embodiments, the drip guard 490 can be formed from other materials, particularly in instances in which the drip guard 490 is separately formed and coupled to the frame 416, front panel 406, mounting plate or rear cover 406*a* of the front panel 406, or other component. For example, the drip guard 490 can be a polymer plate or an aluminum plate, among other materials.

In the exemplary embodiments, a household appliance can include a warming drawer with a fixed warming drawer module and glass heating element or a warming drawer module having a glass heating element that is movable in and out of a warming drawer housing.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. A household appliance comprising:

a warming drawer housing having an interior chamber; and a warming drawer module in the interior chamber, the warming drawer module including:

a support plate;

a heating element forming a floor surface of the warming drawer module, the floor surface for receiving items to be warmed, an underside of the heating element being supported by the support plate;

a frame disposed over an upper perimeter surface of the heating element, the frame secured to the support plate and retaining the heating element there between; and a first electrical connection disposed adjacent to an edge of the frame, wherein the frame includes a drip guard projecting outward from the edge of the frame and overhangs the first electrical connection, the drip guard configured to guide a liquid from a surface of one of the frame and the heating element away from the first electrical connection such that the liquid does not come into contact with the first electrical connection.

2. The household appliance of claim 1, further comprising:

a gasket strip covering the upper perimeter surface of the heating element;

wherein the frame is disposed over the gasket strip and the upper perimeter surface of the heating element, the frame secured to the support plate and retaining the heating element and the gasket strip there between.

3. The household appliance of claim 2, wherein the gasket strip covers an entire upper perimeter surface of the heating element.

4. The household appliance of claim 1, wherein the gasket strip includes a plurality of gaskets coupled together to cover an entire upper perimeter surface of the heating element.

5. The household appliance of claim 1, wherein the gasket strip seals the upper perimeter surface of the heating element to an underside of the frame.

6. The household appliance of claim 1, wherein the drip guard extends along a portion of a length of the edge of the frame.

7. The household appliance of claim 1, wherein the drip guard extends substantially along an entire length of the edge of the frame.

8. The household appliance of claim 1, wherein the drip guard is integrally formed with the edge of the frame.

9. The household appliance of claim 1, wherein the drip guard is coupled to the edge of the frame.

10. The household appliance of claim 1, wherein the frame includes a second drip guard projecting outward from the edge of the frame.

11. The household appliance of claim 1, further comprising:

a plurality of electrical connections disposed adjacent to the edge of the frame, wherein the frame includes a plurality of individual drip guards projecting outward from the edge of the frame and respectively overhanging each of the plurality of electrical connections.

12. The household appliance of claim 1, wherein the drip guard is disposed at an angle other than 90° with respect to an upper surface of the heating element.

13. The household appliance of claim 1, further comprising:

a front panel includes a control unit having a second electrical connection, wherein the edge of the frame is adjacent to the front panel and the first electrical connection, and wherein the first electrical connection is connected to the second electrical connection.

14. The household appliance of claim 13, wherein the first electrical connection is connected to the second electrical connection in an area protected from spills by the drip guard overhanging the area.

15. The household appliance of claim 13, wherein each of the first electrical connection and the second electrical connection is a wiring harness connector.

16. The household appliance of claim 13, wherein the drip guard extends substantially along an entire length of the edge of the frame.

17. The household appliance of claim 13, wherein the front panel includes an interior space and a rear cover closing a side of the interior space facing the frame, the rear cover being adjacent to the frame, wherein the rear cover includes one of an opening and a cutout formed adjacent to the first electrical connection, and wherein the drip guard extends through the one of the opening and the cutout into the interior space of the front panel.

18. The household appliance of claim 17, wherein the front panel includes a lower portion closing a lower side of the interior space from an outside, and wherein the drip guard is configured to guide the liquid from the surface of the one of the frame and the heating element onto the lower portion.

19. The household appliance of claim 18, wherein the lower portion includes a drain hole that permits the liquid to drain to the outside of the front panel.

20. The household appliance of claim 18, wherein the lower portion forms a drain pan to collect and hold the liquid.

21. The household appliance of claim 20, wherein the lower portion includes a drain hole that permits the liquid to drain to the outside of the front panel.

22. The household appliance of claim 1, wherein the drip guard projects outward from the edge of the frame at a location on the edge that is a predetermined distance below an upper surface of the frame in a direction perpendicular to the upper surface of the frame.

23. The household appliance of claim 1, wherein the warming drawer module is movable between a first position in which the warming drawer module is in the interior chamber of the warming drawer housing and a second position in which a part of the warming drawer module is outside the warming drawer housing.

24. The household appliance of claim 1, wherein the support plate supports the heating element in a position above the support plate, the support plate including a plate portion and a plurality of embosses on the plate portion, the plurality of embosses supporting an underside of the heating element at a predetermined distance above the plate portion and forming a space between the plate portion and the underside of the heating element in which electrical wires are disposed.

25. The household appliance of claim 1, further comprising:

a wire guide disposed under the support plate, the wire guide having an open end adjacent to the edge of the frame and the first electrical connection being disposed in the open end of the wire guide, wherein the drip guard is configured to guide the liquid from the surface of the one of the frame and the heating element away from the open end of the wire guide.

26. A household appliance comprising:

a warming drawer housing having an interior chamber; and a warming drawer module in the interior chamber, the warming drawer module including:

a support plate;

a heating element forming a floor surface of the warming drawer module, the floor surface for receiving items to be warmed, an underside of the heating element being supported by the support plate;

a frame disposed over an upper perimeter surface of the heating element, the frame being secured to the support plate and retaining the heating element there between;

a first electrical connection disposed adjacent to an edge of the frame; and means for guiding a liquid from a surface of one of the frame and the heating element away from the first electrical connection such that the liquid does not come into contact with the first electrical connection.

27. The household appliance of claim 26, further comprising:

seal means for sealing the upper perimeter surface of the heating element to the frame, the frame being secured to the support plate and retaining the heating element and the seal means there between.

28. The household appliance of claim 26, wherein the means for guiding the liquid from the surface of the one of the frame and the heating element is integrally formed with and projects outward from the edge of the frame, wherein the means for guiding guides the liquid from the edge of the frame away from the first electrical connection such that the liquid does not come into contact with the first electrical connection.

* * * * *